US008026940B2

(12) United States Patent
Kitao et al.

(10) Patent No.: US 8,026,940 B2
(45) Date of Patent: Sep. 27, 2011

(54) IMAGE FORMING APPARATUS

(75) Inventors: Tomoyuki Kitao, Osaka (JP); Masanori Okada, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 959 days.

(21) Appl. No.: 11/976,753

(22) Filed: Oct. 26, 2007

(65) Prior Publication Data

US 2008/0100690 A1 May 1, 2008

(30) Foreign Application Priority Data

Oct. 30, 2006 (JP) ..... 2006-294113
Oct. 30, 2006 (JP) ..... 2006-294120

(51) Int. Cl.
*B41J 27/00* (2006.01)

(52) U.S. Cl. ..... 347/261; 347/260; 347/243; 347/259

(58) Field of Classification Search ..... 347/234, 347/248, 243, 258, 260–261
See application file for complete search history.

(56) References Cited

U.S. PATENT DOCUMENTS 6,163,327 A * 12/2000 Mori et al. ..... 347/115
6,285,383 B1 * 9/2001 Klement et al. ..... 347/116
2003/0052959 A1 * 3/2003 Fujimoto ..... 347/116
2005/0264646 A1 * 12/2005 Izumiya et al. ..... 347/243

FOREIGN PATENT DOCUMENTS

JP 9-233281 9/1997
JP 2005-351981 12/2005

* cited by examiner

*Primary Examiner* — Stephen Meier
*Assistant Examiner* — Sarah Al Hashimi
(74) *Attorney, Agent, or Firm* — Smith, Gambrell & Russell, LLP

(57) ABSTRACT

A CPU (91) of an image forming apparatus includes a beam detecting part (911) that detects each of laser beams scanning by a predetermined number (e.g., four) of polygon mirrors (332) at a preset position (where a beam sensor (335) is disposed), a reference phase setting part (912) that sets a reference phase that is a phase to be a reference of the predetermined number of rotation phases of the polygon mirrors (332) based on a result of detection by the beam detecting part (911), and a phase control part (913) that controls polygon motor (330) so that predetermined number of rotation phases of the polygon mirrors (332) match the reference phase.

18 Claims, 13 Drawing Sheets

FIG.11

| PHASE DIFFERENCE $\Delta\phi$ ($\mu$sec) | FREQUENCY (kHz) |
|---|---|
| $\Delta\phi \leqq -20$ | 2.03 |
| $-20 < \Delta\phi \leqq -8$ | 2.02 |
| $-8 < \Delta\phi \leqq -2$ | 2.01 |
| $-2 < \Delta\phi < 2$ | 2.00 |
| $2 \leqq \Delta\phi < 8$ | 1.99 |
| $8 \leqq \Delta\phi < 20$ | 1.98 |
| $20 \leqq \Delta\phi$ | 1.97 |

IMAGE FORMING APPARATUS

This application is based on Japanese Patent Applications No. 2006-294113 filed on Oct. 30, 2006 and No. 2006-294120 filed on Oct. 30, 2006.

BACKGROUND OF THE INVENTION

1. Field of the Invention

The present invention relates to an image forming apparatus that forms a color image through the steps of forming latent images by applying laser beams to photosensitive drums via polygon mirrors for two or more predetermined number of colors (e.g., four colors including magenta (M), cyan (C), yellow (Y) and black (K)), forming toner images corresponding to the formed latent images, and superposing the toner images of the predetermined number of colors to be transferred to a paper sheet. In particular, the present invention relates to a color copier, a color printer and a multifunction apparatus having either one of these functions.

2. Description of Related Art

Recently, as for the image forming apparatus such as a copier or a printer that forms a color image through the steps of forming latent images by applying laser beams to photosensitive drums via polygon mirrors for two or more predetermined number of colors (e.g., four colors including magenta (M), cyan (C), yellow (Y) and black (K)), forming toner images corresponding to the formed latent images, and superposing the toner images of the predetermined number of colors to be transferred to a paper sheet (i.e., through a so-called electrophotography process), it becomes a standby state for saving power consumption if a predetermined time period (e.g., a minute) passes without any input such as an external operation.

In this standby state or other states except a printing operation state, polygon motors that drive polygon mirrors are not driven. For this reason, when the apparatus returns from the standby state to an operating state, "rotation phases" of the polygon mirrors corresponding to individual colors may be shifted (i.e., a phase difference is generated) resulting in occurrence of color drift. Therefore, in order to prevent the occurrence of color drift, drive control of the polygon motors should be performed so that two or more predetermined number (e.g., four colors) of rotation phases of the polygon mirrors match each other.

Note that a rotation angle of a direction of a mirror surface of the polygon mirror with respect to a reference direction (e.g., a direction of the perpendicular from the center of the rotation axis of the polygon mirror to the axis of the photosensitive drum) is referred to as the "rotation phase" here. For example, in a case of a polygon mirror having six mirror surfaces, a rotation phase difference between polygon mirrors is within a range of −30 to +30 degrees.

A printer that can make rotation phases of the polygon mirrors match each other includes laser beam detectors for detecting laser beams scanning by the polygon mirrors corresponding to magenta (M), cyan (C), yellow (Y) and black (K) colors at predetermined positions on scanning paths as disclosed in JP-A-H9-233281 for example, and with reference to output signals of the laser beam detectors, rotation phase differences (i.e., phase differences) of all polygon mirrors (e.g., three polygon mirrors of magenta (M), cyan (C) and yellow (Y)) except one polygon mirror as a reference (e.g., a polygon mirror corresponding to black (K)) are calculated with respect to the reference polygon mirror, so that rotation frequencies of the polygon motors corresponding to the three polygon mirrors are changed for predetermined time periods.

Here, one polygon mirror (e.g., a polygon mirror corresponding to black (K)) is regarded as a reference, and the rotation frequency of the polygon motor that drives the other polygon mirror (e.g., a polygon mirror corresponding to magenta (M)) is changed based on the rotation phase difference (i.e., phase difference) of the other polygon mirror (e.g., the polygon mirror corresponding to magenta (M)) in the conventional image forming apparatus such as a printer described above. Therefore, if the rotation phase difference (i.e., phase difference) is large, time period necessary for making the rotation phases match each other (here referred to as phase control time) increases. In addition, if change quantity of the rotation frequency of the polygon motor is increased for decreasing the phase control time, overshoot or undershoot of the rotation frequency of the polygon motor occurs resulting in a difficulty in making the rotation phases match each other.

SUMMARY OF THE INVENTION

An object of the present invention is to provide an image forming apparatus and an image forming method that can make rotation phases of polygon mirrors match each other efficiently.

An image forming apparatus of the present invention is an apparatus that forms a color image through the steps of forming latent images by applying laser beams to photosensitive drums via polygon mirrors for two or more predetermined number of colors, forming toner images corresponding to the formed latent images, and superposing the toner images of the predetermined number of colors to be transferred to a paper sheet. The image forming apparatus includes a polygon driving portion that drives the predetermined number of polygon mirrors to rotate at preset steady-state rotation frequencies, beam detecting portions that detect laser beams scanning by the predetermined number of polygon mirrors at preset positions on scanning paths, a reference phase setting portion that sets a reference phase that is a phase to be a reference of rotation phases of the predetermined number of polygon mirrors based on a result of detection by the predetermined number of beam detecting portions, and a phase control portion that controls the polygon driving portions so that rotation phases of the predetermined number of polygon mirrors match the reference phase.

According to the image forming apparatus described above, laser beams scanning by the predetermined number of polygon mirrors are detected by the beam detecting portions at preset positions on the scanning paths, and the reference phase that is a phase to be a reference of the rotation phases of the predetermined number of polygon mirrors is set based on a result of the detection. Then, the polygon mirror is driven and controlled so that rotation phases of the predetermined number of polygon mirrors match the reference phase. Therefore, rotation phases of the polygon mirrors can match each other efficiently by appropriately setting the reference phase.

In addition, since the reference phase is set based on a result of detection by the beam detecting portions, an appropriate reference phase can be set easily. For example, rotation phases of the polygon mirrors can match each other efficiently by setting a substantially intermediate phase between the most leading phase and the most lagging phase as the reference phase among rotation phases of the predetermined number of polygon mirrors.

In addition, as for the image forming apparatus of the present invention, the reference phase setting portion sets a substantially intermediate phase between the most leading phase and the most lagging phase as the reference phase among rotation phases of the predetermined number of polygon mirrors based on a result of detection by the predetermined number of beam detecting portions.

According to the image forming apparatus described above, a substantially intermediate phase between the most leading phase and the most lagging phase is set as the reference phase among rotation phases of the predetermined number of polygon mirrors based on a result of detection by the beam detecting portions. Therefore, rotation phases of the polygon mirrors can match each other more efficiently.

In other words, according to the conventional method, the polygon driving portion should be controlled so that a rotation phase of the polygon mirror is changed by a phase difference between the most leading phase and the most lagging phase. In contrast, according to the present invention, since the substantially intermediate phase between the most leading phase and the most lagging phase is set as the reference phase, it is sufficient to control the polygon driving portion so that a rotation phase of the polygon mirror is changed by substantially a half of the phase difference between the most leading phase and the most lagging phase. Therefore, rotation phases of the polygon mirrors can match each other more efficiently.

Further, as for the image forming apparatus of the present invention, the phase control portion controls so that rotation phases of the predetermined number of polygon mirrors match the reference phase by increasing or decreasing each of rotation frequencies of the predetermined number of polygon driving portions in stages by a preset predetermined frequency sequentially.

According to the image forming apparatus described above, each of the predetermined number of polygon driving portions increase or decrease each rotation frequency in stages by a preset predetermined frequency sequentially. Therefore, occurrence of overshoot (or undershoot) of rotation frequency is suppressed, so that rotation phases of the polygon mirrors can match each other more efficiently.

In addition, as for the image forming apparatus of the present invention, the polygon driving portion controls the rotation frequency via PLL (Phase Locked Loop), and the predetermined frequency is set to a value equal to or less than a preset threshold value.

According to this image forming apparatus, the rotation frequency is controlled via PLL (Phase Locked Loop), and the predetermined frequency that is a variation of the rotation frequency increased or decreased by the polygon driving portion is set to a value equal to or less than a preset threshold value. Therefore, the PLL is prevented from getting out of the locked state, and rotation phases of the polygon mirrors can match each other more efficiently.

In addition, as for the image forming apparatus of the present invention, if rotation phases of the predetermined number of polygon mirrors lag from the reference phase, the phase control portion sequentially increases a rotation frequency of the corresponding polygon driving portion from the steady-state rotation frequency in stages by a preset predetermined frequency and then decreases in stages by a preset predetermined frequency sequentially to the steady-state rotation frequency. If the rotation phases of the predetermined number of polygon mirrors lead the reference phase, the phase control portion sequentially decreases the rotation frequency of the corresponding polygon driving portion from the steady-state rotation frequency in stages by a preset predetermined frequency and then increases in stages by a preset predetermined frequency sequentially to the steady-state rotation frequency.

According to the image forming apparatus described above, if the rotation phases of the predetermined number of polygon mirrors lag from the reference phase, the rotation frequency of the corresponding polygon driving portion is increased sequentially from the steady-state rotation frequency in stages by a preset predetermined frequency and then is decreased in stages by a preset predetermined frequency sequentially to the steady-state rotation frequency. Therefore, occurrence of overshoot (or undershoot) of rotation frequency is suppressed, and the rotation phases of the polygon mirrors can match each other more efficiently.

Furthermore, if the rotation phases of the predetermined number of polygon mirrors lead the reference phase, the rotation frequency of the corresponding polygon driving portion is decreased sequentially from the steady-state rotation frequency in stages by a preset predetermined frequency and then is increased in stages by a preset predetermined frequency sequentially to the steady-state rotation frequency. Therefore, occurrence of overshoot (or undershoot) of rotation frequency is suppressed, so that rotation phases of the polygon mirrors can match each other more efficiently.

Furthermore, the image forming apparatus of the present invention further includes a pattern storing portion that stores change pattern of the rotation frequency of the polygon driving portion in association with a phase difference between a rotation phase of the polygon mirror and the reference phase. The phase control portion calculates each of phase differences between each of the rotation phases of the predetermined number of polygon mirrors and the reference phase, reads out a change pattern corresponding to the calculated phase difference from the pattern storing portion, and controls rotation frequencies of the predetermined number of polygon driving portions based on the read change pattern.

According to the image forming apparatus described above, each phase difference between each of the rotation phases of the predetermined number of polygon mirrors and the reference phase is calculated, and the change pattern corresponding to the calculated phase difference is read out from the pattern storing portion. Then, the rotation frequency of the corresponding polygon driving portion is controlled based on the read change pattern. Therefore, rotation phases of the polygon mirrors can match each other efficiently by a simple structure.

In addition, as for the image forming apparatus of the present invention, the phase control portion includes a phase difference calculating portion that determines each of phase differences between the reference phase set by the reference phase setting portion and each of the rotation phases of the predetermined number of polygon mirrors based on a result of detection every time when the predetermined number of beam detecting portions detect laser beams, a frequency setting portion that sets rotation frequencies of the predetermined number of polygon driving portions based on the phase differences determined by the phase difference calculating portion, and a frequency control portion that controls the rotation frequencies of the predetermined number of polygon driving portions to be the rotation frequency set by the frequency setting portion.

According to the image forming apparatus described above, each phase difference between the reference phase set by the reference phase setting portion and each of the rotation phases of the predetermined number of polygon mirrors is determined based on a result of detection every time when predetermined number of beam detecting portions detect laser beams. Then, each of rotation frequencies of the predetermined number of polygon driving portions is set based on the phase difference determined by the phase difference calculating portion, and rotation frequencies of the predetermined number of polygon driving portions are controlled to be the set rotation frequencies.

Since the rotation frequencies of the predetermined number of polygon driving portions are controlled in accordance with the phase differences determined based on a result of detection every time when the beam detecting portions detect the laser beams, rotation phases of the polygon mirrors can match each other efficiently. In other words, a rotation phase of the polygon mirror can be made close to the reference phase swiftly by setting the rotation frequency is set to a value such that a frequency difference from the steady-state rotation frequency is larger as the phase difference is larger, for example.

Further, as for the image forming apparatus of the present invention, the reference phase setting portion sets one rotation phase of a polygon mirror as the reference phase among the predetermined number of polygon mirrors.

According to the image forming apparatus described above, one rotation phase of a polygon mirror is set as the reference phase among the predetermined number of polygon mirrors. Therefore, rotation phases of the polygon mirrors can match each other more efficiently by selecting the reference phase appropriately.

For example, an intermediate phase between the most leading phase and the most lagging phase is determined among rotation phases of the predetermined number of polygon mirrors, and a rotation phase of a polygon mirror that is closest to the determined intermediate phase is set as the reference phase. Thus, a phase difference between the rotation phases of the predetermined number of polygon mirrors and the reference phase becomes small, so that rotation phases of the polygon mirrors can match each other more efficiently.

In addition, as for the image forming apparatus of the present invention, the reference phase setting portion sets a substantially intermediate phase between the most leading phase and the most lagging phase as the reference phase among rotation phases in the predetermined number of polygon mirrors based on a result of detection by the predetermined number of beam detecting portions.

According to the image forming apparatus described above, a substantially intermediate phase between the most leading phase and the most lagging phase is set as the reference phase among rotation phases in the predetermined number of polygon mirrors. Therefore, rotation phases of the polygon mirrors can match each other more efficiently.

In other words, according to the conventional method, the polygon driving portion should be controlled so that a rotation phase of the polygon mirror is changed by a phase difference between the most leading phase and the most lagging phase. In contrast, according to the present invention, since a substantially intermediate phase between the most leading phase and the most lagging phase is set as the reference phase, it is sufficient to control the polygon driving portion so that a rotation phase of the polygon mirror is changed by substantially a half of the phase difference between the most leading phase and the most lagging phase. Therefore, rotation phases of the polygon mirrors can match each other more efficiently.

In addition, as for the image forming apparatus of the present invention, the frequency setting portion sets a rotation frequency having larger difference with the steady-state rotation frequency as an absolute value of the phase difference is larger.

According to the image forming apparatus described above, as an absolute value of the phase difference between each of the rotation phases of the predetermined number of polygon mirrors and the reference phase is larger, a rotation frequency having larger difference with the steady-state rotation frequency is set. Therefore, decreasing amount of the phase difference between the each of the rotation phases of the predetermined number of polygon driving portions and the reference phase per unit time (e.g., one millisecond) increases, so that rotation phases of the polygon mirrors can match each other more efficiently.

Further, the image forming apparatus of the present invention further includes a frequency storing portion that stores a rotation frequency in association with the phase difference. The frequency setting portion sets the rotation frequency by reading out a rotation frequency corresponding to the phase difference determined by the phase difference calculating portion from the frequency storing portion.

According to the image forming apparatus described above, the rotation frequency is set by reading out the rotation frequency corresponding to the phase difference determined by the phase difference calculating portion from the frequency storing portion, so an appropriate frequency can be set by a simple structure.

In addition, as for the image forming apparatus of the present invention, the polygon driving portion controls the rotation frequency via PLL (Phase Locked Loop), and the frequency storing portion stores the rotation frequency that is set so as to make a difference between the stored rotation frequency and the steady-state rotation frequency be a value within a preset predetermined range.

According to the image forming apparatus described above, the rotation frequency is controlled via PLL (Phase Locked Loop), and the rotation frequency that is set so as to make a difference between the stored rotation frequency and the steady-state rotation frequency be a value within a preset predetermined range is stored in the frequency storing portion. Therefore, the PLL is prevented from getting out of the locked state, and rotation phases of the polygon mirrors can match each other more efficiently.

An image forming method of the present invention is a method for use in an image forming apparatus that forms a color image through the steps of forming latent images by applying laser beams to photosensitive drums via polygon mirrors for two or more predetermined number of colors, forming toner images corresponding to the formed latent images, and superposing the toner images of the predetermined number of colors to be transferred to a paper sheet, the image forming apparatus including: a polygon driving portion that drives the predetermined number of polygon mirrors to rotate at preset steady-state rotation frequencies; and beam detecting portions that detect laser beams scanning by the predetermined number of polygon mirrors at preset positions on scanning paths. Here, the image forming method involves performing: a reference phase setting step for setting a reference phase that is a phase to be a reference of rotation phases of the predetermined number of polygon mirrors based on a result of detection by the predetermined number of beam detecting portions; and a phase control step for controlling the polygon driving portions so that rotation phases of the predetermined number of polygon mirrors match the reference phase.

According to the image forming method described above, laser beams scanning by the predetermined number of polygon mirrors are detected by the beam detecting portions at preset positions on the scanning paths, and the reference phase that is a phase to be a reference of the rotation phases of the predetermined number of polygon mirrors is set based on a result of the detection. Then, the polygon mirror is driven and controlled so that rotation phases of the predetermined number of polygon mirrors match the reference phase. Thus, it is possible to make the rotation phases of the polygon mirrors match each other efficiently by appropriately setting the reference phase.

In addition, since the reference phase is set based on a result of detection by the beam detecting portions, an appropriate reference phase can be set easily. For example, rotation phases of the polygon mirrors can match each other efficiently by setting a substantially intermediate phase between the most leading phase and the most lagging phase as the reference phase among rotation phases of the predetermined number of polygon mirrors.

In addition, as for the image forming method of the present invention, in the reference phase setting step, a substantially intermediate phase between the most leading phase and the most lagging phase among rotation phases of the predetermined number of polygon mirrors is set as the reference phase based on a result of detection by the predetermined number of beam detecting portions.

According to the image forming method described above, a substantially intermediate phase between the most leading phase and the most lagging phase is set as the reference phase among rotation phases of the predetermined number of polygon mirrors based on a result of detection by the beam detecting portions. Therefore, rotation phases of the polygon mirrors can match each other more efficiently.

In other words, according to the conventional method, the polygon driving portion should be controlled so that a rotation phase of the polygon mirror is changed by a phase difference between the most leading phase and the most lagging phase. In contrast, according to the present invention, since substantially intermediate phase between the most leading phase and the most lagging phase is set as the reference phase, it is sufficient to control the polygon driving portion so that a rotation phase of the polygon mirror is changed by substantially a half of the phase difference between the most leading phase and the most lagging phase. Therefore, rotation phases of the polygon mirrors can match each other more efficiently.

Furthermore, as for the image forming method of the present invention, in the phase control step, control is performed so that rotation phases of the predetermined number of polygon mirrors match the reference phase by increasing or decreasing each of rotation frequencies of the predetermined number of polygon driving portions in stages by a preset predetermined frequency sequentially.

According to the image forming method described above, each of the predetermined number of polygon driving portions increase or decrease each rotation frequency in stages by a preset predetermined frequency sequentially. Therefore, occurrence of overshoot (or undershoot) of rotation frequency is suppressed, so that rotation phases of the polygon mirrors can match each other more efficiently.

In addition, as for the image forming method of the present invention, in the phase control step, if rotation phases of the predetermined number of polygon mirrors lag from the reference phase, a rotation frequency of a corresponding polygon driving portion is sequentially increased from the steady-state rotation frequency in stages by a preset predetermined frequency and is then decreased in stages by a preset predetermined frequency sequentially to the steady-state rotation frequency, and if the rotation phases of the predetermined number of polygon mirrors lead the reference phase, a rotation frequency of a corresponding polygon driving portion is sequentially decreased from the steady-state rotation frequency in stages by a preset predetermined frequency and is then increased in stages by a preset predetermined frequency sequentially to the steady-state rotation frequency.

According to the image forming method described above, if the rotation phases of the predetermined number of polygon mirrors lag from the reference phase, the rotation frequency of the corresponding polygon driving portion is increased sequentially from the steady-state rotation frequency in stages by a preset predetermined frequency and then is decreased in stages by a preset predetermined frequency sequentially to the steady-state rotation frequency. Therefore, occurrence of overshoot (or undershoot) of rotation frequency is suppressed, and the rotation phases of the polygon mirrors can match each other more efficiently.

Furthermore, if the rotation phases of the predetermined number of polygon mirrors lead the reference phase, the rotation frequency of the corresponding polygon driving portion is decreased sequentially from the steady-state rotation frequency in stages by a preset predetermined frequency and then is increased in stages by a preset predetermined frequency sequentially to the steady-state rotation frequency. Therefore, occurrence of overshoot (or undershoot) of rotation frequency is suppressed, so that rotation phases of the polygon mirrors can match each other more efficiently.

In addition, as for the image forming method of the present invention, the phase control step involves performing: a phase difference calculating step for determining each of phase differences between the reference phase set in the reference phase setting step and each of the rotation phases of the predetermined number of polygon mirrors based on a result of detection every time when the predetermined number of beam detecting portions detect laser beams; a frequency setting step for setting rotation frequencies of the predetermined number of polygon driving portions based on the phase differences determined in the phase difference calculating step; and a frequency control step for controlling the rotation frequencies of the predetermined number of polygon driving portions to be the rotation frequency set in the frequency setting step.

According to the image forming method described above, each phase difference between the reference phase set by the reference phase setting portion and each of the rotation phases of the predetermined number of polygon mirrors is determined based on a result of detection every time when predetermined number of beam detecting portions detect laser beams. Then, each of rotation frequencies of the predetermined number of polygon driving portions is set based on the phase difference determined by the phase difference calculating portion, and rotation frequencies of the predetermined number of polygon driving portions are controlled to be the set rotation frequencies.

Since the rotation frequencies of the predetermined number of polygon driving portions are controlled in accordance with the phase differences determined based on a result of detection every time when the beam detecting portions detect the laser beams, rotation phases of the polygon mirrors can match each other efficiently. In other words, a rotation phase of the polygon mirror can be made close to the reference phase swiftly by setting the rotation frequency is set to a value such that a frequency difference from the steady-state rotation frequency is larger as the phase difference is larger, for example.

Moreover, as for the image forming method of the present invention, in the reference phase setting step, one rotation phase of a polygon mirror among the predetermined number of polygon mirrors is set as the reference phase.

According to the image forming method described above, one rotation phase of a polygon mirror is set as the reference phase among the predetermined number of polygon mirrors.

Therefore, rotation phases of the polygon mirrors can match each other more efficiently by selecting the reference phase appropriately.

For example, an intermediate phase between the most leading phase and the most lagging phase is determined among rotation phases of the predetermined number of polygon mirrors, and a rotation phase of a polygon mirror that is closest to the determined intermediate phase is set as the reference phase. Thus, a phase difference between the rotation phases of the predetermined number of polygon mirrors and the reference phase becomes small, so that rotation phases of the polygon mirrors can match each other more efficiently.

In addition, as for the image forming method of the present invention, in the reference phase setting step, a substantially intermediate phase between the most leading phase and the most lagging phase among rotation phases in the predetermined number of polygon mirrors is set as the reference phase based on a result of detection by the predetermined number of beam detecting portions.

According to the image forming method described above, a substantially intermediate phase between the most leading phase and the most lagging phase is set as the reference phase among rotation phases in the predetermined number of polygon mirrors. Therefore, rotation phases of the polygon mirrors can match each other more efficiently.

In other words, according to the conventional method, the polygon driving portion should be controlled so that a rotation phase of the polygon mirror is changed by a phase difference between the most leading phase and the most lagging phase. In contrast, according to the present invention, since a substantially intermediate phase between the most leading phase and the most lagging phase is set as the reference phase, it is sufficient to control the polygon driving portion so that a rotation phase of the polygon mirror is changed by substantially a half of the phase difference between the most leading phase and the most lagging phase. Therefore, rotation phases of the polygon mirrors can match each other more efficiently.

In addition, as for the image forming method of the present invention, in the frequency setting step, a rotation frequency having larger difference with the steady-state rotation frequency is set as an absolute value of the phase difference is larger.

According to the image forming method described above, as an absolute value of the phase difference between each of the rotation phases of the predetermined number of polygon mirrors and the reference phase is larger, a rotation frequency having larger difference with the steady-state rotation frequency is set. Therefore, decreasing amount of the phase difference between the each of the rotation phases of the predetermined number of polygon mirrors and the reference phase per unit time (e.g., one millisecond) increases, so that rotation phases of the polygon mirrors can match each other more efficiently.

BRIEF DESCRIPTION OF THE DRAWINGS

FIG. 11 is a table showing an example of phase differences $\Delta\phi$ and rotation frequencies stored in a frequency storing part.

DETAILED DESCRIPTION OF THE PREFERRED EMBODIMENTS

Figure 1:
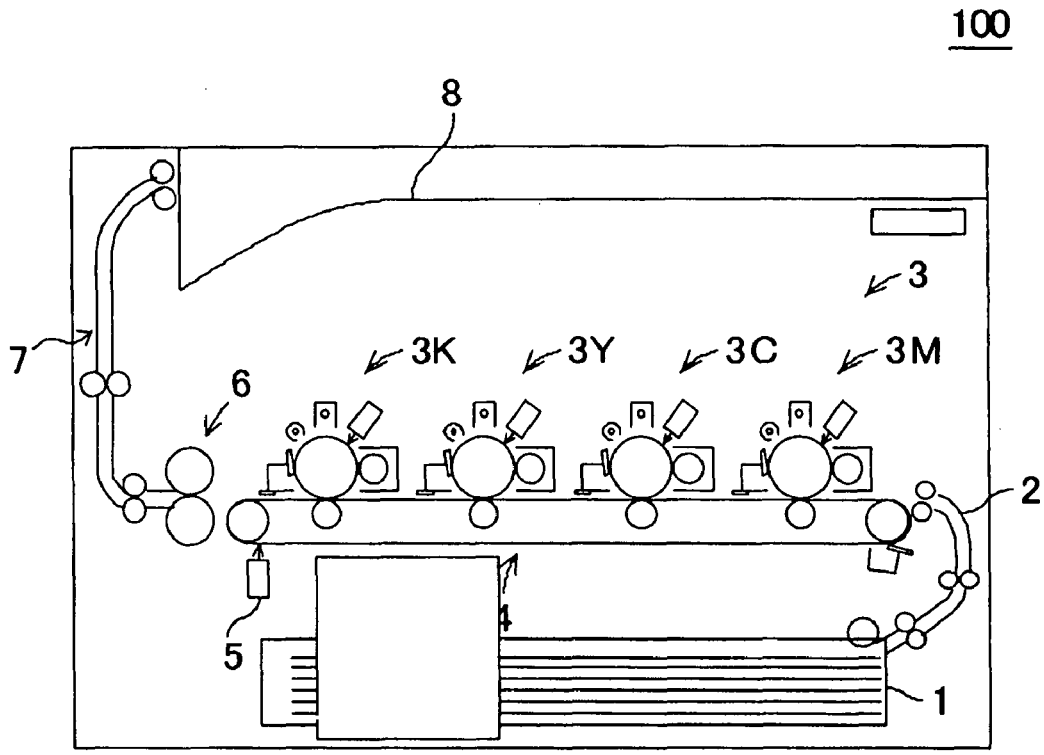
FIG. 1 is a block diagram showing an example of a general structure of a printer according to the present invention.

Hereinafter, an example of an image forming apparatus according to the present invention will be described with reference to the attached drawings. FIG. 1 is a block diagram showing an example of a general structure of a printer according to the present invention. Although a case where the image forming apparatus is a printer will be described here, it may be other image forming apparatus (e.g., a copier, a multifunction apparatus or the like), which forms a color image through the steps of forming latent images by applying laser beams to photosensitive drums via polygon mirrors for two or more predetermined number of colors, forming toner images corresponding to the formed latent images, and superposing the toner images of the predetermined number of colors to be transferred to a paper sheet.

As shown in FIG. 1, a printer 100 includes a paper sheet feeder 1, a first transport path 2, an image forming unit 3, an intermediate transferring unit 4, a density sensor 5, a fixing unit 6, a second transport path 7 and a delivery tray 8. In addition, the printer 100 is provided with a control part 9 (see FIG. 4) (or a control part 9A (see FIG. 9)) for controlling actions of the printer 100 at an appropriate position (not shown). In addition, the printer 100 is connected to a personal computer (PC) or the like (not shown) so as to communicate with the same, and it receives an original image from the PC for forming an image corresponding to the original image on a paper sheet.

The paper sheet feeder 1 stores stacked paper sheets and has a mechanism for feeding a paper sheet at the top responding to an instruction from the control part 9 (or the control part 9A) as described later. The first transport path 2 conveys a paper sheet fed from the paper sheet feeder 1 to the image forming unit 3. The image forming unit 3 includes image forming units 3M, 3C, 3Y and 3K for magenta (M), cyan (C), yellow (Y) and black (K), which form and superpose a predetermined number of colors (here, four colors including magenta (M), cyan (C), yellow (Y) and black (K)) of toner images on a paper sheet conveyed from the first transport path 2.

The intermediate transferring unit 4 conveys a paper sheet supplied from the first transport path 2 to the fixing unit 6 via the image forming unit 3 and forms a toner image corresponding to the original image received from a PC (not shown) via the image forming unit 3 (or a color drift correction pattern). The density sensor 5 senses density of the color drift correction pattern formed on the intermediate transferring unit 4 by the image forming unit 3. The fixing unit 6 performs heat fixing of the toner image formed on the paper sheet by the intermediate transferring unit 4. The second transport path 7 is disposed at a downstream side of the fixing unit 6, and it conveys the paper sheet on which the toner image is heat fixed by the fixing unit 6 to the delivery tray 8. The delivery tray 8 is disposed at a downstream side of the second transport path 7, on which paper sheets after heat fixing are stacked.

Figure 2:
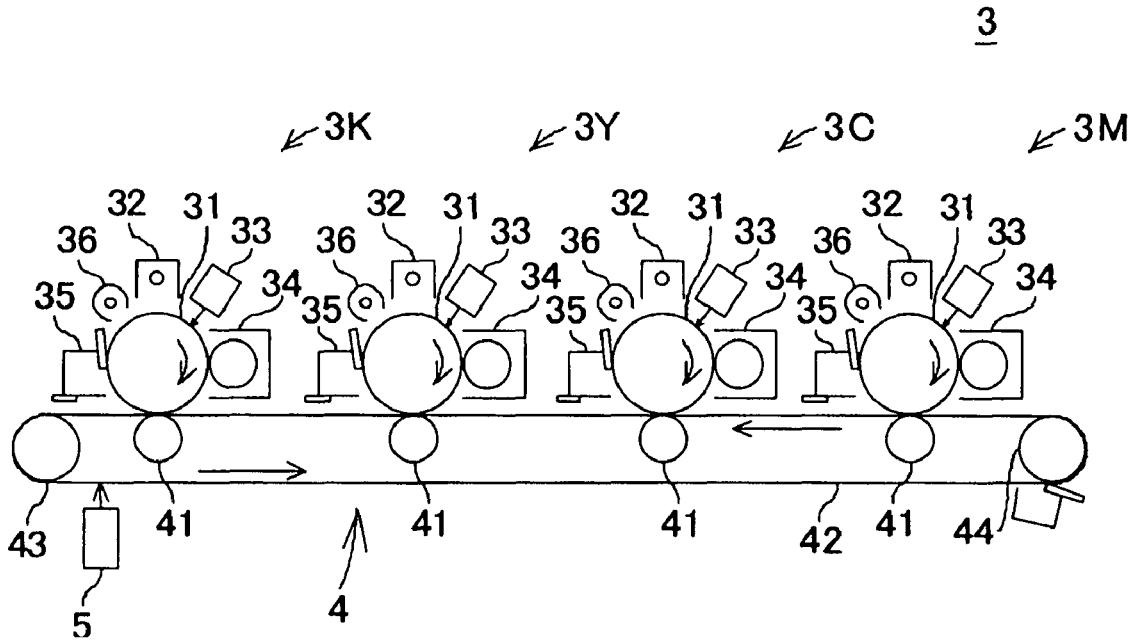
FIG. 2 is a block diagram showing an example of an image forming unit and an intermediate transferring unit shown in FIG. 1.

FIG. 2 is a block diagram showing an example of the image forming unit 3 and the intermediate transferring unit 4 shown in FIG. 1. The image forming units 3M, 3C, 3Y and 3K for magenta (M), cyan (C), yellow (Y) and black (K) of the image forming unit 3 have substantially the same structure, and each of them includes a charger 32, a laser irradiation unit 33, a developing unit 34, a cleaner 35 and a charge eliminator 36 disposed around a photosensitive drum 31 in this order from a position above the photosensitive drum 31 along the rotation direction (as shown by an arrow).

The photosensitive drum 31 rotates in the clockwise direction (as shown by an arrow), and the surface of the photosensitive drum 31 is electrified uniformly by the charger 32. Next, the laser irradiation unit 33 projects laser light corresponding to the original image received from a PC or the like (not shown) (or the color drift correction pattern), so that an electrostatic latent image is formed on the surface of the photosensitive drum 31.

Then, the developing unit 34 supplies toner to the electrostatic latent image on the photosensitive drum 31, which is visualized as a toner image. Next, the photosensitive drum 31 further rotates, and the toner image is transferred from the photosensitive drum 31 to the paper sheet conveyed by the intermediate transferring unit 4. Residual toner that was not transferred is removed from the photosensitive drum 31 by the cleaner 35 having a blade or the like contacting with the photosensitive drum 31, and next the charge eliminator 36 removes surface charge of the photosensitive drum 31. Thus, a series of image forming process is completed.

The intermediate transferring unit 4 includes a primary transfer roller 41, an endless belt 42 and drive rollers 43 and 44. The endless belt 42 is arranged to contact with the photosensitive drums 31 of the image forming units 3M, 3C, 3Y and 3K at the upper outer surface. The color drift correction pattern is formed on the endless belt 42 via the image forming unit 3, and the endless belt 42 is supported by the drive rollers 43 and 44. The drive rollers 43 and 44 support the endless belt 42, and they drive the endless belt 42 to turn in the counter-clockwise direction (as shown by arrows) in FIG. 2.

Figure 3:
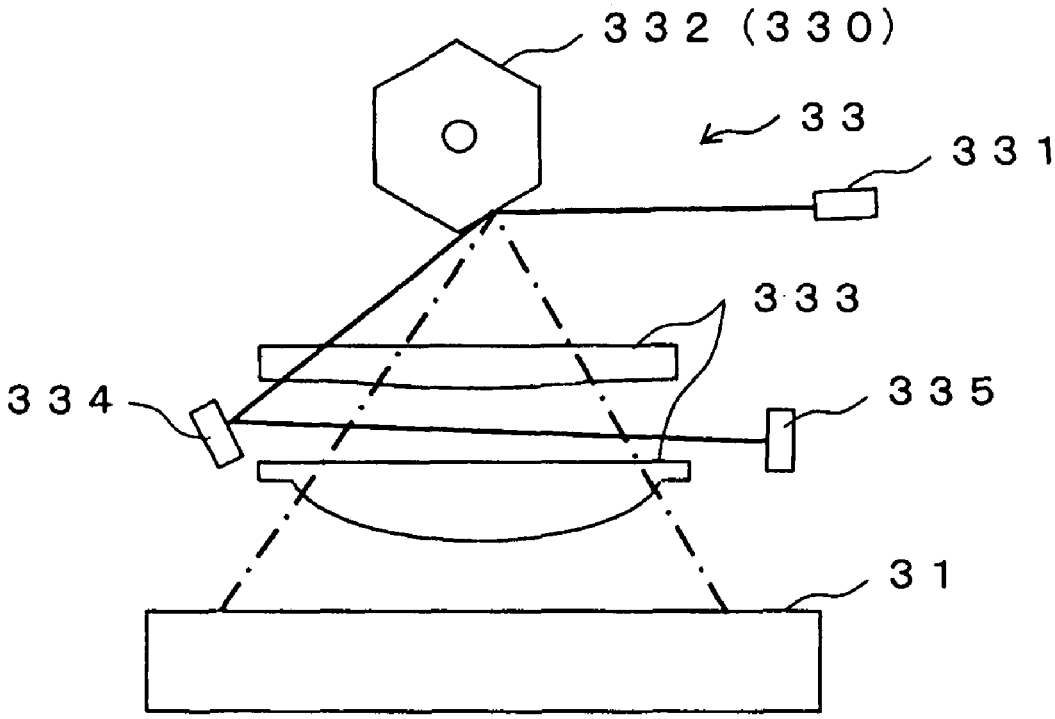
FIG. 3 is a block diagram showing an example of a structure of a laser irradiation unit shown in FIG. 2.

FIG. 3 is a block diagram showing an example of a structure of the laser irradiation unit 33 shown in FIG. 2. The laser irradiation unit 33 includes a polygon motor 330, a laser diode 331, a polygon mirror 332, an fθ lens 333, a sensing mirror 334 and a beam sensor 335.

The laser beam emitted from the laser diode 331 enters the polygon mirror 332 that is driven to rotate by the polygon motor 330. The polygon mirror 332 has a shape of equilateral hexagon and is driven by the polygon motor 330 (not shown) so as to rotate at a uniform rate in the clockwise direction.

In addition, the polygon motor 330 (corresponding to a part of the polygon driving portion) is driven in accordance with an instruction from the CPU 91 of the control part 9 (or the CPU 91A of the control part 9A) via a motor driving device 37 (or a motor driving device 37A) that will be described later with reference to FIGS. 4 and 9. Note that the polygon mirror 332 may have other shapes without limiting to the equilateral hexagon shape, as long as it is a regular polygon. In addition, the rotation direction and rotation speed of the polygon mirror 332 may be modified in accordance with a specification of the apparatus, if necessary.

The laser beam reflected by the polygon mirror 332 enters the fθ lens 333 and is converted into that of uniform speed, which is focused to form an image of a beam spot on the photosensitive drum 31 via a mirror (not shown). Thus, the laser beam scans the photosensitive drum 31 in a main scanning direction (in the left direction in FIG. 3). The sensing mirror 334 reflects the laser beam emitted from the laser diode 331 toward the beam sensor 335, and it is disposed on the left side of the fθ lens 333.

The beam sensor 335 (corresponding to a part of a beam detecting portion) is made up of a photosensor or the like such as a photodiode or a phototransistor, and it is disposed on the right side of the fθ lens 333. It senses the laser beam scanning by the polygon mirror 332 at a position on the scanning path where the sensing mirror 334 is disposed (here at the left side of the fθ lens 333). In addition, a sense signal of the beam sensor 335 (hereinafter referred to as a BD (Beam Detect) signal) is supplied to the CPU 91 of the control part 9 (or the CPU 91A of the control part 9A) that will be described with reference to FIGS. 4 and 9.

First Embodiment

Figure 4:
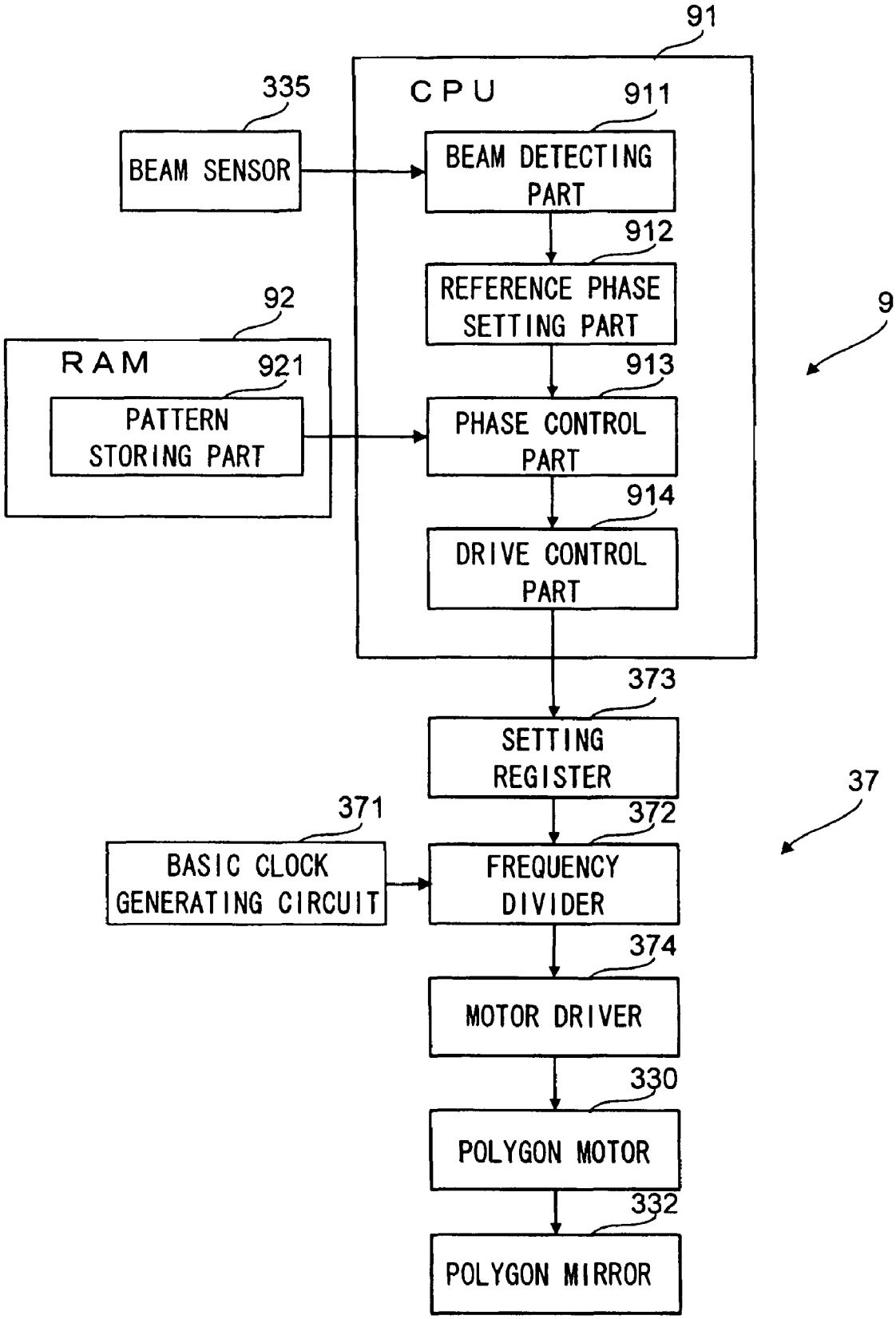
FIG. 4 is a block diagram showing an example of a structure of a main part according to a first embodiment of the present invention.

FIG. 4 is a block diagram showing an example of a structure of a main part according to a first embodiment of the present invention. The control part 9 that controls actions of the printer 100 includes the CPU (Central Processing Unit) 91, a RAM (Random Access Memory) 92, and a ROM (Read Only Memory) (not shown). In addition, the motor driving device 37 (corresponding to a part of the polygon driving portion) responds to an instruction from the CPU 91 (a drive control part 914 that will be described later) so as to control the polygon motor 330 that drives the polygon mirror 332 shown in FIG. 3 to rotate. The motor driving device 37 includes a basic clock generating circuit 371, a frequency divider 372, a setting register 373 and a motor driver 374.

The basic clock generating circuit 371 is made up of a quartz oscillator or the like and generates a clock signal of a frequency (here, 2 MHz) that is higher than a steady-state rotation frequency of the polygon motor 330 (hereinafter referred to as a "basic clock signal"), which is delivered to the frequency divider 372.

The frequency divider 372 divides the basic clock signal from the basic clock generating circuit 371 so as to generate a clock signal of a frequency set in the setting register 373, and the generated clock signal is delivered to the motor driver 374.

The setting register 373 stores a frequency that is set by the CPU 91 (a drive control part 914 that will be described later) (hereinafter referred to as a set frequency) and delivers the set frequency to the frequency divider 372.

The motor driver 374 controls rotation speed of the polygon motor 330 by PLL (Phase Locked Loop) control based on the clock signal from the frequency divider 372. More specifically, the motor driver 374 controls the rotation speed of the polygon motor 330 to be a value (e.g., 2000 rps (2000 revolutions per second)) corresponding to a frequency (e.g., 2 kHz) set in the setting register 373.

The CPU 91 includes functionally a beam detecting part 911, a reference phase setting part 912, a phase control part 913 and the drive control part 914, while the RAM 92 includes functionally a pattern storing part 921. Here, when the CPU 91 reads out a program stored in the ROM or the like in advance and executes the program, the CPU 91 works as functional parts including the beam detecting part 911, the reference phase setting part 912, the phase control part 913, the drive control part 914 and the like, while the RAM 92 works as functional parts including the pattern storing part 921 and the like.

Among various data stored in the RAM 92 or the ROM, data that can be stored in a removable recording medium may be readable by a driver of a hard disk drive, an optical disc drive, a flexible disc drive, a silicon disc drive, a cassette media reader, or the like, for example. In this case, the recording medium may be a hard disk, an optical disc, a flexible disc, a CD (Compact Disk), a DVD (Digital Versatile Disk), a semiconductor memory, or the like, for example.

The beam detecting part 911 (corresponding to a part of the beam detecting portion) receives the sense signal from the beam sensor 335 so as to detect the laser beam scanning by the polygon mirror 332 at a preset position on the scanning path (the position where the beam sensor 335 is disposed as shown in FIG. 3) for generating the BD signal.

The reference phase setting part 912 (corresponding to the reference phase setting portion) sets a reference phase that is a phase to be a reference for the rotation phase of the polygon mirror 332 based on a result of the detection by the beam detecting part 911 (i.e., the BD signal) (i.e., performs a reference phase setting step). Here, the reference phase setting part 912 sets an intermediate phase between a most leading phase and a most lagging phase as the reference phase among rotation phases of a predetermined number (four in this example) polygon mirrors 332 based on the result of the detection by a predetermined number (four in this example) of beam sensors 335.

Figure 5:
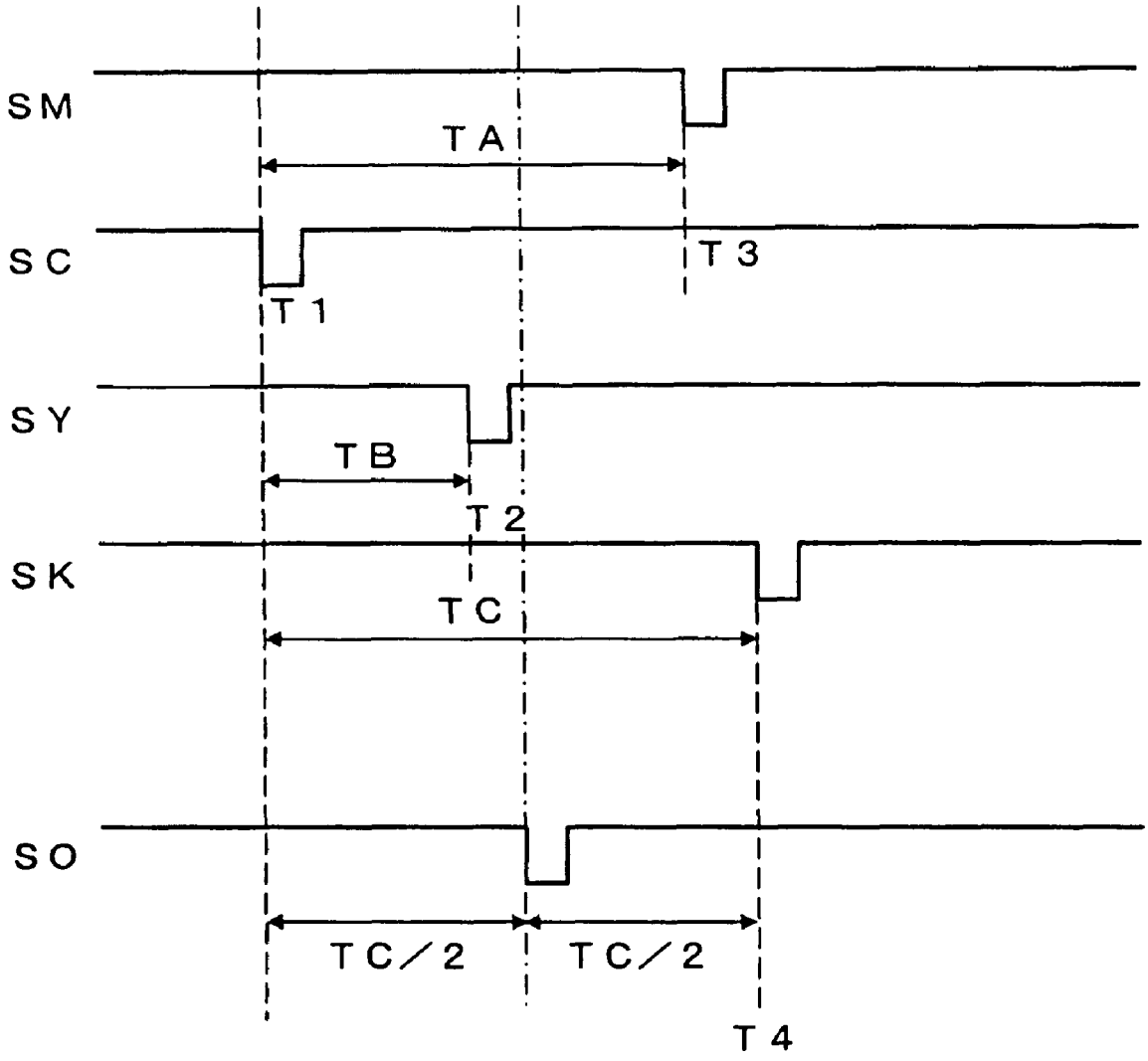
FIG. 5 is a timing chart showing an example of a method for setting a reference phase performed by a reference phase setting part.

FIG. 5 is a timing chart showing an example of a method for setting the reference phase performed by the reference phase setting part 912. FIG. 5 shows BD signals SM, SC, SY and SK corresponding to magenta (M), cyan (C), yellow (Y) and black (K) colors, and a reference phase signal S0 in this order from the upper side. Here, with respect to the BD signal SC corresponding to cyan (C), phases of the BD signals SM, SY and SK corresponding to magenta (M), yellow (Y) and black (K) colors lead by time periods TA, TB and TC, respectively.

Therefore, the reference phase setting part 912 generates the reference phase signal S0 having a phase (i.e., reference phase) at the middle between the BD signal SK having the most leading phase and the BD signal SC having the most lagging phase.

With reference to FIG. 4 again, a functional structure of the CPU 91 will be described. The phase control part 913 (corresponding to the phase control portion) controls the polygon motor 330 so that rotation phases of a predetermined number (e.g., four) of polygon mirrors 332 match the reference phase corresponding to the reference phase signal S0 (i.e., performs a phase control step). In addition, the phase control part 913 controls a predetermined number (e.g., four) of polygon motors 330 so as to match the reference phase corresponding to the reference phase signal S0 by increasing or decreasing each rotation frequency in stages by a predetermined frequency ΔF that is preset.

Furthermore, if rotation phases of a predetermined number (e.g., four) of polygon mirrors 332 lag from the reference phase corresponding to the reference phase signal S0, the phase control part 913 increases a rotation frequency of the corresponding polygon motor 330 from the steady-state rotation frequency (e.g., 2 kHz) in stages by a preset predetermined frequency ΔFA (e.g., 10 Hz), and then it decreases the rotation frequency in stages by a preset predetermined frequency ΔFB (e.g., 10 Hz) sequentially to the steady-state rotation frequency (e.g., 2 kHz).

Note that the predetermined frequencies ΔFA and ΔFB (e.g., 10 Hz) are set to values below a predetermined threshold value. More specifically, the predetermined frequencies ΔFA and ΔFB are set to values (e.g., 50 Hz that is a preset threshold value) below a threshold value smaller than critical change frequency (e.g., 300 Hz) before getting out of the locked state when the motor driver 374 performs PLL control of a rotation speed of the polygon motor 330.

For example, in the case shown in FIG. 5, the BD signals SC and SY corresponding to cyan (C) and yellow (Y) colors lag from the reference phase corresponding to the reference phase signal S0 (see FIG. 5). Therefore, in order to make the BD signals SC and SY corresponding to cyan (C) and yellow (Y) lead by time periods (TC/2) and (TC/2−TB) respectively, the phase control part 913 increases sequentially a rotation frequency of the corresponding polygon motor 330 from the steady-state rotation frequency (e.g., 2 kHz) in stages by a preset predetermined frequency (e.g., 10 Hz), and then decreases it sequentially to the steady-state rotation frequency (e.g., 2 kHz) in stages by a preset predetermined frequency (e.g., 10 Hz).

In addition, if rotation phases of a predetermined number (e.g., four) of polygon mirrors 332 lead from the reference phase corresponding to the reference phase signal S0, the phase control part 913 decreases sequentially the rotation frequency of the corresponding polygon motor 330 from the steady-state rotation frequency (e.g., 2 kHz) in stages by a preset predetermined frequency ΔFB (e.g., 10 Hz), and then increases it in stages by a preset predetermined frequency ΔFA (e.g., 10 Hz) sequentially to the steady-state rotation frequency (e.g., 2 kHz).

For example, in the case shown in FIG. 5, the BD signals SM and SK corresponding to magenta (M) and black (K) colors lead from the reference phase corresponding to the reference phase signal S0. Therefore, in order to make the BD signals SM and SK corresponding to magenta (M) and black (K) by time periods (TA−TC/2) and (TC/2), the phase control part 913 decreases sequentially the rotation frequency of the corresponding polygon motor 330 from the steady-state rotation frequency (e.g., 2 kHz) in stages by a preset predetermined frequency (e.g., 10 Hz), and then increases it in stages by a preset predetermined frequency (e.g., 10 Hz) sequentially to the steady-state rotation frequency (e.g., 2 kHz).

In addition, the phase control part 913 calculates each phase difference between each of rotation phases of a predetermined number (e.g., four) of polygon mirrors 332 and the reference phase corresponding to the reference phase signal S0 (see FIG. 5), and it reads out the change pattern corresponding to the calculated phase difference from the pattern storing part 921. Then, it controls rotation frequencies of the predetermined number (e.g., four) of polygon motors 330 based on the read change pattern.

The drive control part 914 controls the polygon motors 330 via the setting register 373, the frequency divider 372 and the motor driver 374 so that rotation phases of a predetermined number (e.g., four) of polygon mirrors 332 match the reference phase corresponding to the reference phase signal S0 (see FIG. 5).

The pattern storing part 921 (corresponding to the pattern storing portion) stores the change pattern that is a pattern for changing rotation frequencies of the polygon motors 330, in association with each phase difference between each rotation phase of the polygon mirror 332 and the reference phase corresponding to the reference phase signal S0 (see FIG. 5).

Figure 6A:
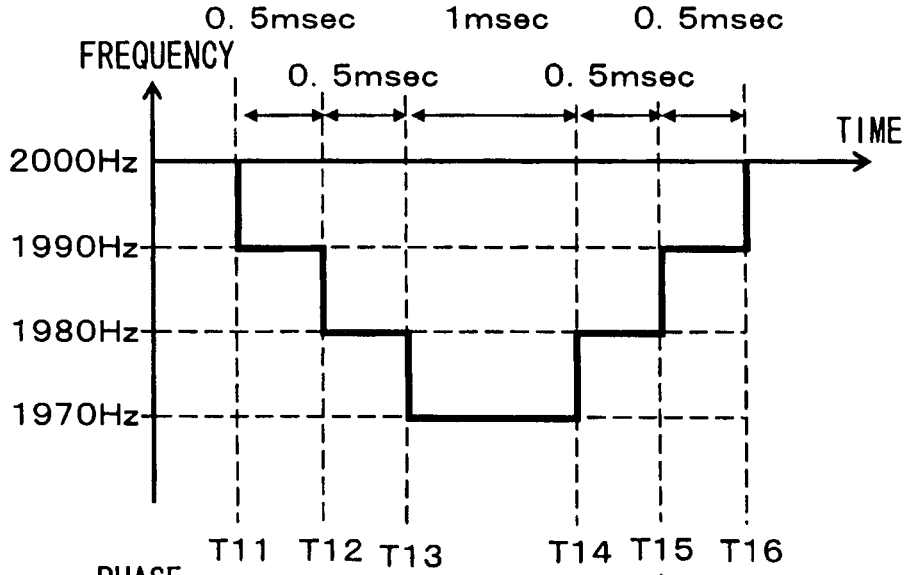
FIG. 6 is a graph showing an example of a change pattern stored in a pattern storing part.
Figure 6B:
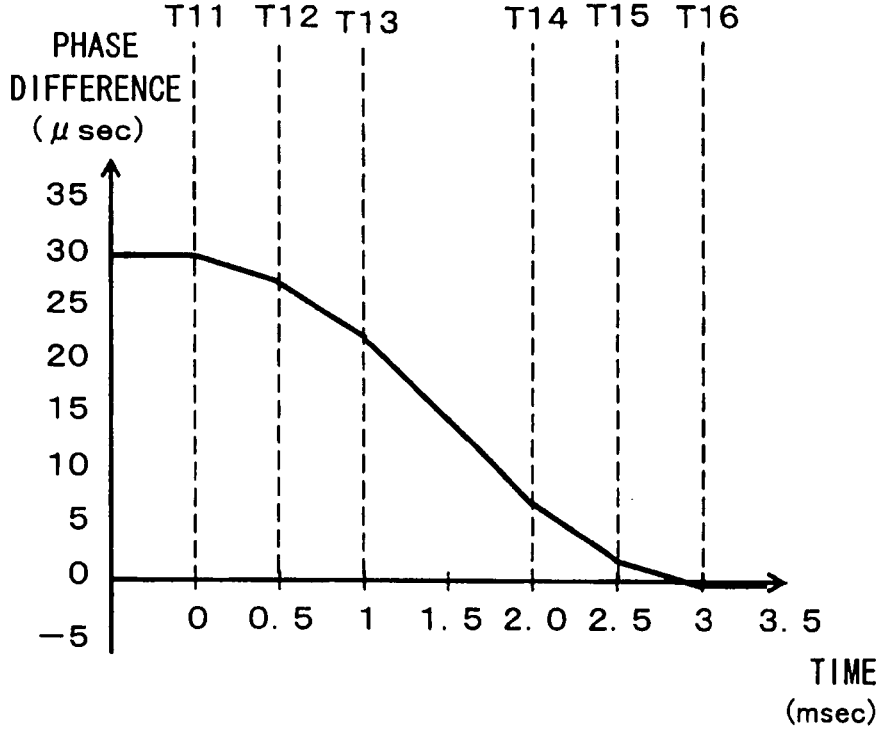

FIG. 6 is a graph showing an example of the change pattern stored in the pattern storing part 921. Section (a) of FIG. 6 is a graph showing an example of the change pattern stored in the pattern storing part 921, and Section (b) of FIG. 6 is a graph showing a change of the rotation phase of the polygon mirror 332. Here, the following description is about the case where the rotation phase of the polygon mirror 332 leads the reference phase corresponding to the reference phase signal S0 (see FIG. 5) by 30 microseconds (i.e., a rotation angle of 21.6 degrees (i.e., 30/1,000,000/(1/2,000)×360 degrees).

As shown in Section (a) of FIG. 6, at the timing of time point T11, the phase control part 913 decreases a rotation frequency of the polygon motor 330 from the steady-state rotation frequency (e.g., 2 kHz) by 10 Hz so as to set it to 1.99 kHz. Then, at the timing of time point T12 that is 0.5 milliseconds (i.e., time period corresponding to one period of the steady-state rotation frequency (e.g., 2 kHz)) after the time point T11, the phase control part 913 further decreases the rotation frequency by 10 Hz so as to set it to 1.98 kHz. Further, at the timing of time point T13 that is 0.5 milliseconds (i.e., time period corresponding to one period of the steady-state rotation frequency (e.g., 2 kHz)) after the time point T12, the phase control part 913 further decreases the rotation frequency by 10 Hz so as to set it to 1.97 kHz.

Then, at the timing of time point T14 that is 1.0 milliseconds (i.e., time period corresponding to two periods of the steady-state rotation frequency (e.g., 2 kHz)) after the time point T13, the phase control part 913 increases the rotation frequency by 10 Hz so as to set it to 1.98 kHz. Next, at the timing of time point T15 that is 0.5 milliseconds (i.e., time period corresponding to one period of the steady-state rotation frequency (e.g., 2 kHz)) after the time point T14, the phase control part 913 further increases the rotation frequency by 10 Hz so as to set it to 1.99 kHz. Further, at the timing of time point T16 that is 0.5 milliseconds (i.e., time period corresponding to one period of the steady-state rotation frequency (e.g., 2 kHz)) after the time point T15, the phase control part 913 further increases the rotation frequency by 10 Hz so as to set it to 2.0 kHz (i.e., the steady-state rotation frequency).

In this way, the phase control part 913 decreases the rotation frequency of the polygon motor 330 from the steady-state rotation frequency (e.g., 2 kHz) in stages by a predetermined frequency (e.g., 10 Hz) sequentially, and then it increases the rotation frequency in stages by a predetermined frequency (e.g., 10 Hz) sequentially to the steady-state rotation frequency (e.g., 2 kHz). Therefore, the rotation phase of the polygon mirror 332 alters as shown in Section (b) of FIG. 6, so as to be substantially the same as the reference phase corresponding to the reference phase signal S0 (see FIG. 5).

Figure 7A:
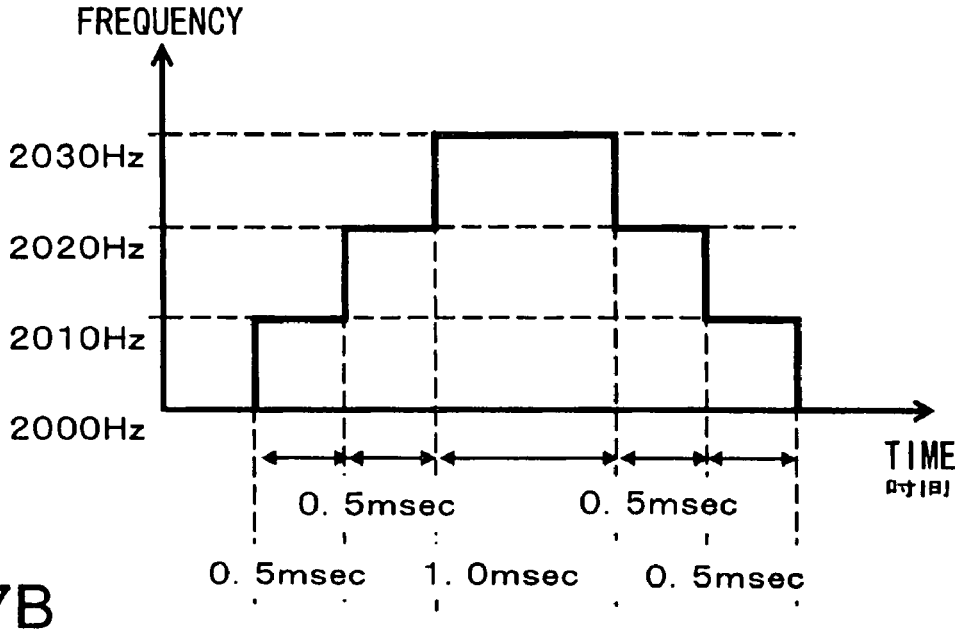
FIG. 7 is a graph showing another example of a change pattern stored in the pattern storing part, which is different from that shown in FIG. 6.
Figure 7B:
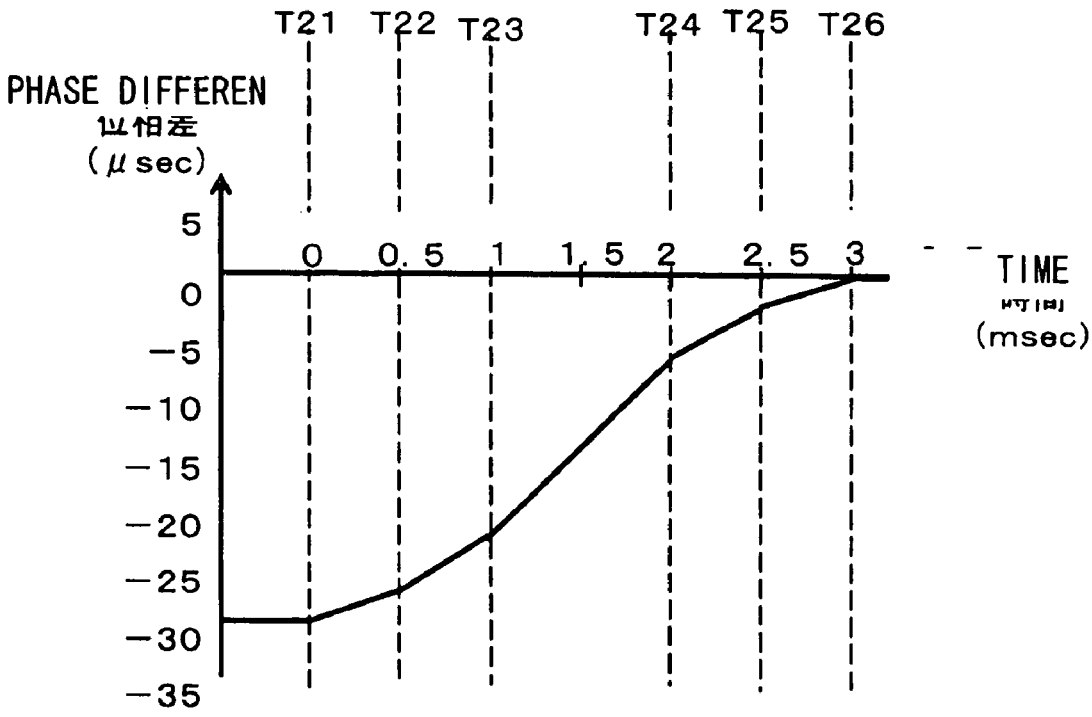

FIG. 7 is a graph showing another example of the change pattern stored in the pattern storing part 921, which is different from that shown in FIG. 6. Section (a) of FIG. 7 is a graph showing an example of the change pattern stored in the pattern storing part 921, and Section (b) of FIG. 7 is a graph showing a change of the rotation phase of the polygon mirror 332. Here, the following description is about the case where the rotation phase of the polygon mirror 332 lags from the reference phase corresponding to the reference phase signal S0 (see FIG. 5) by 30 microseconds (i.e., rotation angle of 21.6 degrees (i.e., 30/1,000,000/(1/2,000)×360 degrees).

As shown in Section (a) of FIG. 7, at the timing of time point T21, the phase control part 913 increases a rotation frequency of the polygon motor 330 from the steady-state rotation frequency (e.g., 2 kHz) by 10 Hz so as to set it to 2.01 kHz. Then, at the timing of time point T22 that is 0.5 milliseconds (i.e., time period corresponding to one period of the steady-state rotation frequency (e.g., 2 kHz)) after the time point T21, the phase control part 913 further increases the rotation frequency by 10 Hz so as to set it to 2.02 kHz. Further, at the timing of time point T23 that is 0.5 milliseconds (i.e., time period corresponding to one period of the steady-state rotation frequency (e.g., 2 kHz)) after the time point T22, the phase control part 913 further increases the rotation frequency by 10 Hz so as to set it to 2.03 kHz.

Then, at the timing of time point T24 that is 1.0 milliseconds (i.e., time period corresponding to two periods of the steady-state rotation frequency (e.g., 2 kHz)) after the time point T23, the phase control part 913 decreases the rotation frequency by 10 Hz so as to set it to 2.02 kHz. Next, at the timing of time point T25 that is 0.5 milliseconds (i.e., time period corresponding to one period of the steady-state rotation frequency (e.g., 2 kHz)) after the time point T24, the phase control part 913 further decreases the rotation frequency by 10 Hz so as to set it to 2.01 kHz. Further, at the timing of time point T26 that is 0.5 milliseconds (i.e., time period corresponding to one period of the steady-state rotation frequency (e.g., 2 kHz)) after the time point T25, the phase control part 913 further decreases the rotation frequency by 10 Hz so as to set it to 2.0 kHz (i.e., steady-state rotation frequency).

In this way, the phase control part 913 increases the rotation frequency of the polygon motor 330 from the steady-state rotation frequency (e.g., 2 kHz) in stages by a predetermined frequency (e.g., 10 Hz) sequentially, and then it decreases the rotation frequency in stages by a predetermined frequency (e.g., 10 Hz) sequentially to the steady-state rotation frequency (e.g., 2 kHz). Therefore, the rotation phase of the polygon mirror 332 alters as shown in Section (b) of FIG. 7, so as to be substantially the same as the reference phase corresponding to the reference phase signal S0 (see FIG. 5).

Figure 8:
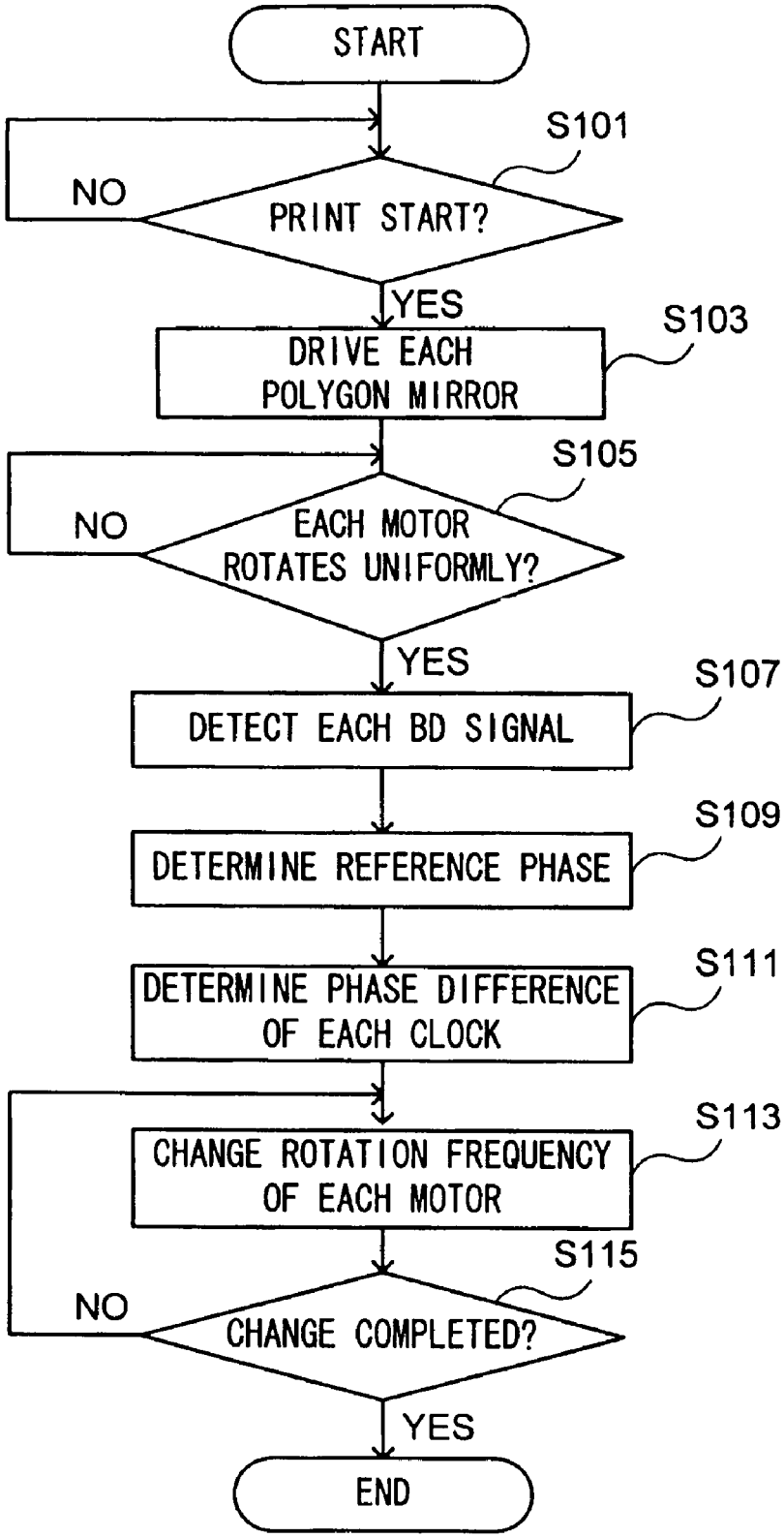
FIG. 8 is a flowchart showing an example of an action of a printer (mainly a CPU) according to the first embodiment of the present invention.

FIG. 8 is a flowchart showing an example of actions of the printer 100 (mainly the CPU 91) according to the first embodiment. Here, the case where the printer 100 is in the standby state as an initial state (i.e., the state where the polygon motor 330 for driving the polygon mirror 332 is not driven) will be described. First, the reference phase setting part 912 determines whether or not the personal computer (PC) or the like has issued instruction information for starting to print (S101). Then, if it is determined that the instruction information for starting to print is not issued (NO in S101), the process becomes the standby state.

If it is determined that the instruction information for starting to print is issued (YES in S101), the reference phase setting part 912 starts to drive the polygon motor 330 (S103). Then, the reference phase setting part 912 determines whether or not the polygon motor 330 has become uniform rotation at the steady-state rotation frequency (e.g., 2 kHz) (S105). If it is determined that it has not become uniform rotation (NO in S105), the process becomes the standby state. If it is determined that it has become uniform rotation (YES in S105), the beam detecting part 911 generates the BD signal via the beam sensor 335 (S107).

Then, the reference phase setting part 912 sets the reference phase that is a phase to be a reference of the rotation phase of the polygon mirror 332, based on a result of detection by the beam detecting part 911 (i.e., the BD signal) (S109). Next, the phase control part 913 calculates each phase difference between each of the rotation phases of a predetermined number (e.g., four) of polygon mirrors 332 and the reference phase corresponding to the reference phase signal S0 (see FIG. 5) (S111).

Then, the phase control part 913 reads out the change pattern corresponding to the calculated phase difference from the pattern storing part 921 in the step S111, so that the rotation frequency of the polygon motor 330 is changed in accordance with the change pattern (S113). Next, the phase control part 913 determines whether or not the rotation frequency of the polygon motor 330 corresponding to the change pattern has been changed (S115). If it is determined that it has not been changed yet (NO in S115), the process goes back to the step S113, and the process after the step S113 is performed repeatedly. If it is determined that it has been changed (YES in S115), the process is finished.

In this way, the beam detecting part 911 detects each of the laser beams scanning by a predetermined number (e.g., four) of polygon mirrors 332 on the preset position on the scanning path (the position where the beam sensor 335 is disposed as shown in FIG. 3), and the reference phase that is a phase to be a reference of the rotation phases of a predetermined number (e.g., four) of polygon mirrors 332 is set. Then, the polygon motor 330 is driven and controlled so that the rotation phases of a predetermined number (e.g., four) of polygon mirrors 332 match the reference phase. Therefore, the rotation phases of the polygon mirrors 332 can match each other efficiently by setting the reference phase appropriately.

In addition, since the reference phase is set based on a result of detection by the beam detecting part 911, an appropriate reference phase can be set easily. For example, as shown in FIG. 5, among the rotation phases of a predetermined number (e.g., four) of polygon mirrors 332, a substantially intermediate phase between the most leading phase and the most lagging phase is set as the reference phase. Thus, rotation phases of the polygon mirrors 332 can match each other efficiently (see FIG. 5).

In the conventional method, it is necessary to control the polygon motor 330 so as to change rotation phase of the polygon mirror 332 by a phase difference between the most leading phase and the most lagging phase. However, if the substantially intermediate phase between the most leading phase and the most lagging phase is set as the reference phase, it is sufficient to control the polygon motor 330 so as to change rotation phase of the polygon mirror 332 by substantially a half of the phase difference between the most leading phase and the most lagging phase. Therefore, rotation phases of the polygon mirrors 332 can match each other more efficiently.

Further, since each of the predetermined number (e.g., four) of polygon motors 330 increases and decreases each rotation frequency in stages by a preset predetermined frequency (e.g., 10 Hz) sequentially, occurrence of overshoot (or undershoot) of the rotation frequency can be suppressed so that rotation phases of the polygon mirrors 332 can match each other more efficiently.

In addition, rotation frequency of the polygon motor 330 is controlled via the PLL (Phase Locked Loop) of the motor driver 374, and the predetermined frequency (e.g., 10 Hz) that is a variation of the rotation frequency increased or decreased by the polygon motor 330 is set to a value below the preset threshold value (e.g., 100 Hz), the PLL is prevented from getting out of the locked state so that rotation phases of the polygon mirrors 332 can match each other more efficiently.

Furthermore, if the rotation phases of a predetermined number (e.g., four) of polygon mirrors 332 lag from the reference phase, rotation frequency of the corresponding polygon motor 330 is increased sequentially from the steady-state rotation frequency (e.g., 2 kHz) in stages by a preset predetermined frequency ΔFA. (e.g., 10 Hz), and then it is decreased in stages by a preset predetermined frequency ΔFB (e.g., 10 Hz) to the steady-state rotation frequency (e.g., 2 kHz) sequentially. Thus, occurrence of overshoot (or undershoot) of rotation frequency is suppressed, so that rotation phases of the polygon mirrors 332 can match each other more efficiently.

Similarly, if the rotation phases of a predetermined number (e.g., four) of polygon mirrors 332 lead the reference phase, rotation frequency of the corresponding polygon motor 330 is decreased from the steady-state rotation frequency (e.g., 2 kHz) in stages by a preset predetermined frequency ΔFB (e.g., 10 Hz) sequentially, and then it is increased in stages by a preset predetermined frequency ΔFA sequentially to the steady-state rotation frequency (e.g., 2 kHz). Therefore, occurrence of overshoot (or undershoot) of rotation frequency is suppressed, and rotation phases of the polygon mirrors can match each other more efficiently.

In addition, each phase difference between each of rotation phases of a predetermined number (e.g., four) of polygon mirrors 332 and the reference phase is calculated, and the change pattern corresponding to the calculated phase difference is read out from the pattern storing part 921. Then, rotation frequency of the corresponding polygon motor 330 is controlled based on the read change pattern, and rotation phase of the polygon mirror 332 can match each other efficiently with a simple structure.

Note that the present invention can also be embodied as follows.

(A) Although in the first embodiment the reference phase setting part 912 sets intermediate phase between the most leading phase and the most lagging phase as the reference phase among rotation phases of a predetermined number (e.g., four) of polygon mirrors 332 based on results of detection by a predetermined number (e.g., four) of beam sensors 335, the reference phase setting part 912 may set the reference phase by other methods.

For example, the reference phase setting part 912 may determine the intermediate phase between the most leading phase and the most lagging phase among rotation phases of a predetermined number (e.g., four) of polygon mirrors 332, and may set rotation phase of the polygon mirror 332 that is closest to the determined intermediate phase as the reference phase (the BD signal SY corresponding to yellow (Y) is set as the reference phase signal S0 in the example shown in FIG. 5).

(B) Although in the first embodiment the predetermined frequencies ΔFA and ΔFB that are variations of frequency increased or decreased by the phase control part 913 are constant (e.g., 10 Hz), the predetermined frequencies ΔFA and ΔFB that are variations of frequency increased or decreased by the phase control part 913 may be variable. For example, it is possible that as rotation phase of the polygon mirror 332 becomes closer to the reference phase, the predetermined frequencies ΔFA and ΔFB are decreased. In this case, rotation phases of polygon mirrors 332 can match each other more accurately.

(C) In the first embodiment, if rotation phase of the polygon mirror 332 lags from the reference phase, the phase control part 913 increases sequentially rotation frequency of the corresponding polygon motor 330 from the steady-state rotation frequency (e.g., 2 kHz) in stages by a preset predetermined frequency ΔFA (e.g., 10 Hz) and then decreases it in stages by a preset predetermined frequency ΔFB (e.g., 10 Hz) sequentially to the steady-state rotation frequency (e.g., 2 kHz). However, it is possible that if rotation phase of the polygon mirror 332 lags from the reference phase, phase control part 913 decreases it in stages at least when frequency is decreased.

More specifically, if rotation phase of the polygon mirror 332 lags from the reference phase, the phase control part 913 increases it by a preset predetermined frequency ΔFA (e.g., 30 Hz) at one time and then decreases it in stages by a preset predetermined frequency ΔFB (e.g., 10 Hz) sequentially to the steady-state rotation frequency (e.g., 2 kHz). On the contrary, if rotation phase of the polygon mirror 332 leads the reference phase, the phase control part 913 decreases it by a preset predetermined frequency ΔFB (e.g., 30 Hz) at one time and then increases it in stages by a preset predetermined frequency ΔFA (e.g., 10 Hz) sequentially to the steady-state rotation frequency (e.g., 2 kHz). In this case, the process can be simplified.

In addition, the phase control part 913 may increase or decrease frequency only once. More specifically, if rotation phase of the polygon mirror 332 lags from the reference phase, the phase control part 913 increases it only once by a preset predetermined frequency ΔFA (e.g., 30 Hz) and then decreases it only once by a preset predetermined frequency ΔFB (e.g., 30 Hz). In addition, it is possible that if rotation phase of the polygon mirror 332 leads the reference phase, the phase control part 913 decreases it only once by a preset predetermined frequency ΔFB (e.g., 30 Hz) and then increases it only once by a preset predetermined frequency ΔFA (e.g., 30 Hz). In this case, the process can be simplified.

Second Embodiment

Figure 9:
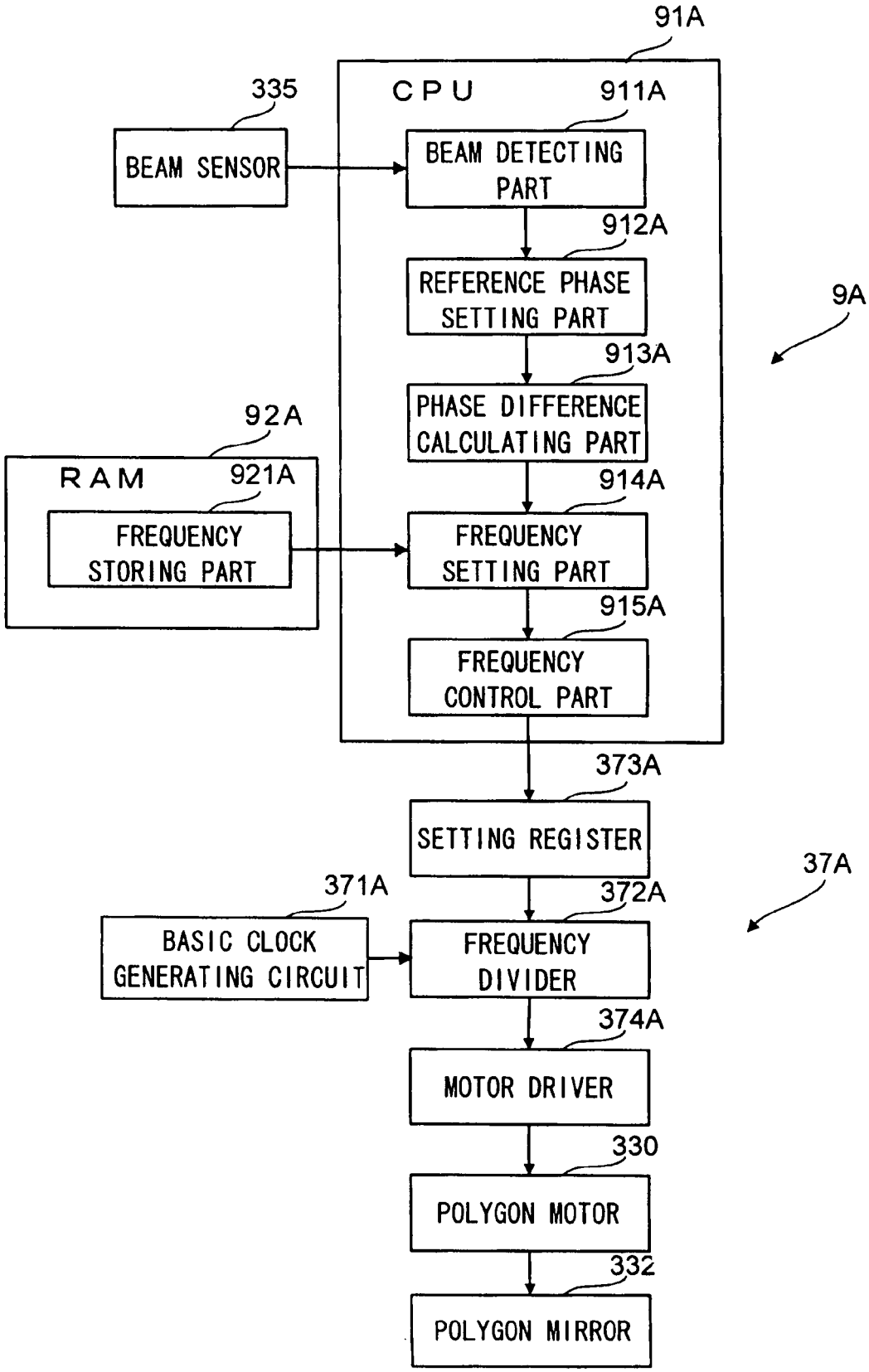
FIG. 9 is a block diagram showing an example of a structure of a main part according to a second embodiment of the present invention.

FIG. 9 is a block diagram showing an example of a structure of a main part according to a second embodiment of the present invention. The control part 9A that controls actions of the printer 100 includes a CPU (Central Processing Unit) 91A, a RAM (Random Access Memory) 92A, and a ROM (Read Only Memory) (not shown). In addition, the motor driving device 37A (corresponding to a part of the polygon driving portion) responds to an instruction from the CPU 91A (a frequency control part 915A that will be described later) so as to control the polygon motor 330 that drives the polygon mirror 332 shown in FIG. 3 to rotate. The motor driving device 37A includes a basic clock generating circuit 371A, a frequency divider 372A, a setting register 373A, and a motor driver 374A.

The basic clock generating circuit 371A is made up of a quartz oscillator or the like and generates a clock signal of a frequency (here, 2 MHz) that is higher than a steady-state rotation frequency of the polygon motor 330 (hereinafter referred to as a "basic clock signal"), which is delivered to the frequency divider 372A.

The frequency divider 372A divides the basic clock signal from the basic clock generating circuit 371A so as to generate a clock signal of a frequency set in the setting register 373A, and the generated clock signal is delivered to the motor driver 374A.

The setting register 373A stores a frequency that is set by the CPU 91A (a frequency control part 915A that will be described later) (hereinafter referred to as a set frequency) and delivers the set frequency to the frequency divider 372A.

The motor driver 374A controls rotation speed of the polygon motor 330 by PLL (Phase Locked Loop) control based on the clock signal from the frequency divider 372A. More specifically, the motor driver 374A controls the rotation speed of the polygon motor 330 to be a value (e.g., 2000 rps (2000 revolutions per second)) corresponding to a frequency (e.g., 2 kHz) set in the setting register 373A.

The CPU 91A includes functionally a beam detecting part 911A, a reference phase setting part 912A, a phase difference calculating part 913A, a frequency setting part 914A and the frequency control part 915A, while the RAM 92A includes functionally a frequency storing part 921A. Here, when the CPU 91A reads out a program stored in the ROM or the like in advance and executes the program, the CPU 91A works as functional parts including the beam detecting part 911A, the reference phase setting part 912A, the phase difference calculating part 913A, the frequency setting part 914A, the frequency control part 915A and the like, while the RAM 92A works as functional parts including the frequency storing part 921A and the like.

Among various data stored in the RAM 92A or the ROM, data that can be stored in a removable recording medium may be readable by a driver of a hard disk drive, an optical disc drive, a flexible disc drive, a silicon disc drive, a cassette media reader or the like, for example. In this case, the recording medium may be a hard disk, an optical disc, a flexible disc, a CD, a DVD, a semiconductor memory or the like.

The beam detecting part 911A (corresponding to a part of the beam detecting portion) receives the sense signal from the beam sensor 335 so as to detect the laser beam scanning by the polygon mirror 332 at a preset position on the scanning path (the position where the beam sensor 335 is disposed as shown in FIG. 3) for generating the BD signal.

The reference phase setting part 912A (corresponding to the reference phase setting portion) sets a reference phase that is a phase to be a reference for the rotation phase of the polygon mirror 332 based on a result of the detection by the beam detecting part 911A (i.e., BD signal) (i.e., performs a reference phase setting step). Here, the reference phase setting part 912A sets an intermediate phase between the most leading phase and the most lagging phase among rotation phases of a predetermined number (e.g., four) of polygon mirrors 332 based on the result of the detection by a predetermined number (four in this example) of beam sensors 335.

Figure 10:
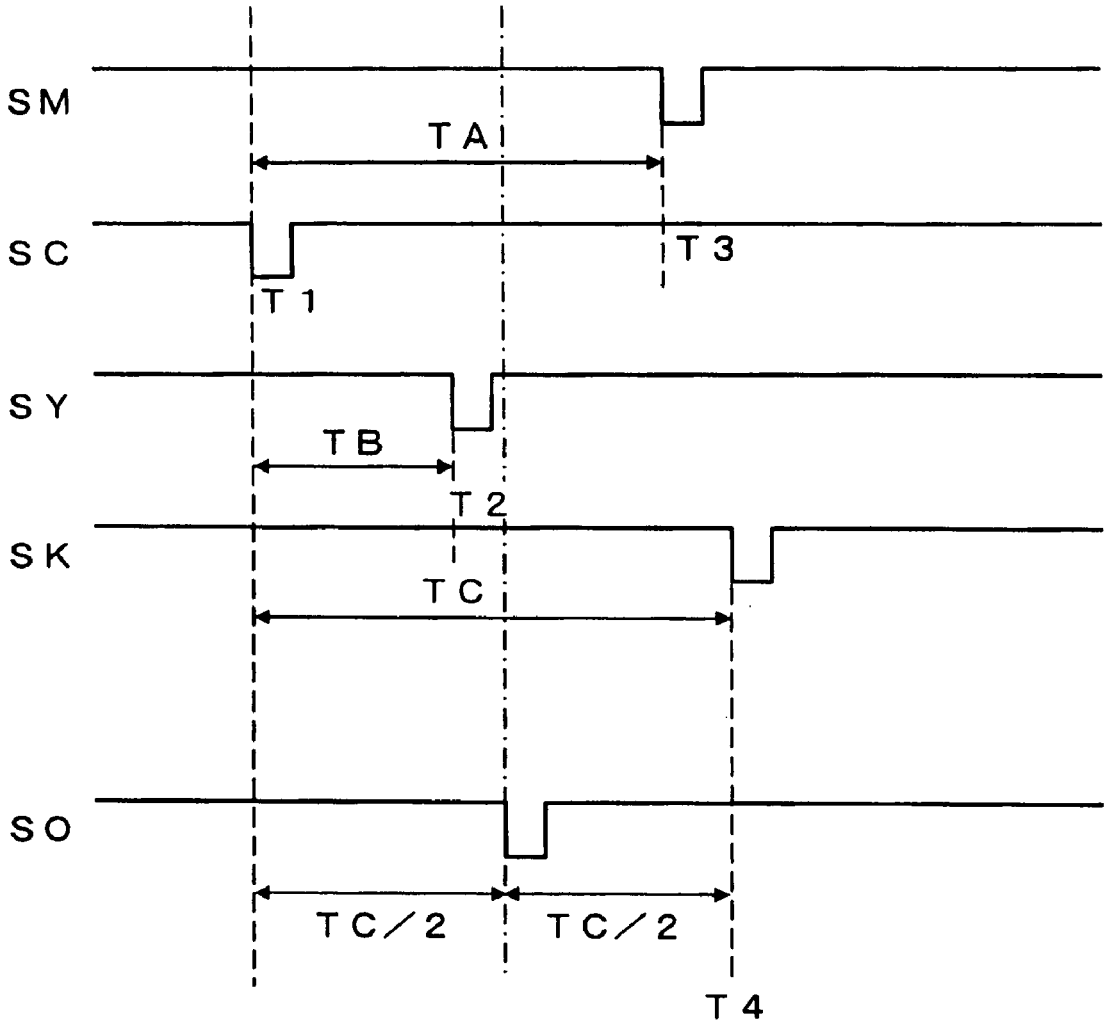
FIG. 10 is a timing chart showing an example of a method for setting a reference phase performed by a reference phase setting part.

FIG. 10 is a timing chart showing an example of a method for setting the reference phase performed by the reference phase setting part 912A. FIG. 10 shows BD signals SM, SC, SY and SK corresponding to magenta (M), cyan (C), yellow (Y) and black (K) colors, and a reference phase signal S0 from the upper side. Here, with respect to the BD signal SC corresponding to cyan (C), phases of the BD signals SM, SY and SK corresponding to magenta (M), yellow (Y) and black (K) colors lead by time periods TA, TB and TC, respectively.

Therefore, the reference phase setting part 912A generates the reference phase signal S0 having a phase (i.e., reference phase) at the middle between the BD signal SK having the most leading phase and the BD signal SC having the most lagging phase.

With reference to FIG. 9 again, a functional structure of the CPU 91A will be described. The phase difference calculating part 913A (corresponding to a part of the phase control portion and the phase difference calculating portion) determines each phase difference between the reference phase set by the reference phase setting part 912A and each of rotation phases of a predetermined number (e.g., four) of polygon mirrors 332 based on a result of detection every time when the beam detecting part 911A detects the laser beam (i.e., every time when the BD signal is generated) (i.e., performs a phase difference calculating step, which is part of a phase control step).

For example, if the BD signal shown in FIG. 10 is generated, the phase difference calculating part 913A determines the phase differences corresponding to magenta (M), cyan (C), yellow (Y) and black (K) colors as time periods (TA−TC/2), (−TC/2), (TB−TC/2), and (TC/2), respectively. Here, if the time period indicating a phase difference is positive, it means that rotation phase of the polygon mirrors 332 leads the reference phase. If the time period indicating a phase difference is negative, it means that rotation phase of the polygon mirrors 332 lags from the reference phase.

The frequency setting part 914A (corresponding to a part of the phase control portion and the frequency setting portion) sets each of the rotation frequencies of the predetermined number (e.g., four) of polygon motors 330 based on the phase difference determined by the phase difference calculating part 913A (i.e., performs a frequency setting step, which is part of the phase control step). In addition, the frequency setting part 914A sets the rotation frequency to a value having larger difference from the steady-state rotation frequency (e.g., 2 kHz) as an absolute value of the phase difference determined by the phase difference calculating part 913A is larger (see FIG. 11). Further, the frequency setting part 914A reads out rotation frequency corresponding to the phase difference determined by the phase difference calculating part 913A from the frequency storing part 921A so as to set the rotation frequency.

The frequency control part 915A (corresponding to a part of the phase control portion and a frequency control portion) controls rotation frequencies of the predetermined number (e.g., four) of polygon motors 330 via the setting register 373A, the frequency divider 372A and the motor driver 374A such that those rotation frequencies are equal to the rotation frequency set by the frequency setting part 914A (i.e., performs a frequency control step, which is part of the phase control step).

The frequency storing part 921A (corresponding to the frequency storing portion) stores rotation frequency of the polygon motor 330 in association with a phase difference between the reference phase set by the reference phase setting part 912A and rotation phase of the polygon mirrors 332. In addition, the frequency storing part 921A stores rotation frequency set for making a difference between the stored rotation frequency and the steady-state rotation frequency (e.g., 2 kHz) be a value within a preset predetermined range (e.g., equal to or less than 100 Hz).

FIG. 11 is a table showing an example of a phase difference Δϕ and a rotation frequency stored in the frequency storing part 921A. As shown in FIG. 11, if the phase difference Δϕ between the reference phase set by the reference phase setting part 912A and the rotation phase of t polygon mirrors 332 is equal to or less than −20 microseconds, the frequency storing part 921A stores 2.03 kHz, for example. If it is more (i.e., larger) than −20 microseconds and equal to or less than −8 microseconds, the frequency storing part 921A stores 2.02 kHz. If it is more (i.e., larger) than −8 microseconds and equal to or less than −2 microseconds, the frequency storing part 921A stores 2.01 kHz.

In addition, if the phase difference Δϕ between the reference phase set by the reference phase setting part 912 and the rotation phase of the polygon mirrors 332 is equal to or more than 20 microseconds, the frequency storing part 921A stores 1.97 kHz. If it is equal to or more than 8 microseconds and less than 20 microseconds, the frequency storing part 921A stores 1.98 kHz. If it is equal to or more than 2 microseconds and less than 8 microseconds, the frequency storing part 921A stores 1.99 kHz.

If the phase difference Δϕ between the reference phase set by the reference phase setting part 912A and the rotation phase of the polygon mirrors 332 is more than −2 microseconds and less than 2 microseconds, it stores 2.0 kHz (i.e., the steady-state rotation frequency). In other words, if the phase difference between the reference phase set by the reference phase setting part 912A and the rotation phase of the polygon mirrors 332 is more than −2 microseconds and less than 2 microseconds, frequency of the polygon motor 330 is set to the steady-state rotation frequency (i.e., 2.0 kHz).

Figure 12A:
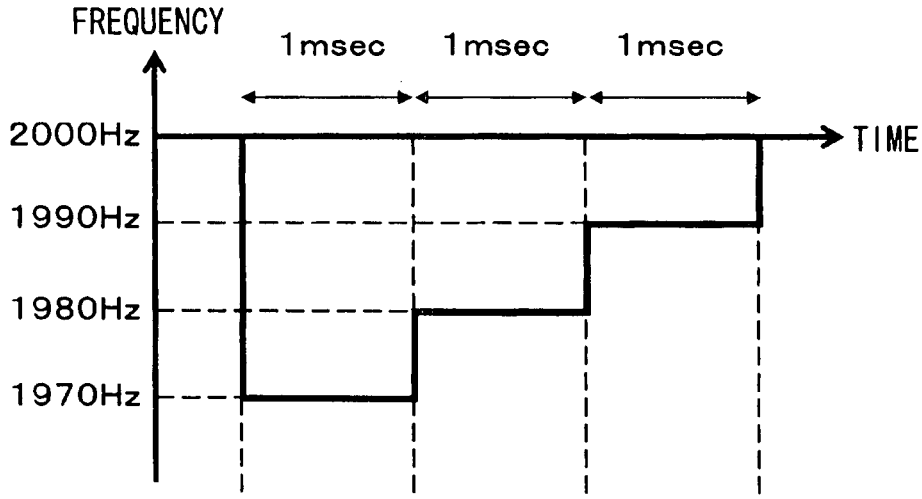
FIG. 12 is a graph showing an example of phase differences $\Delta\phi$ that are calculated by a phase difference calculating part and frequencies that are set by a frequency setting part.
Figure 12B:
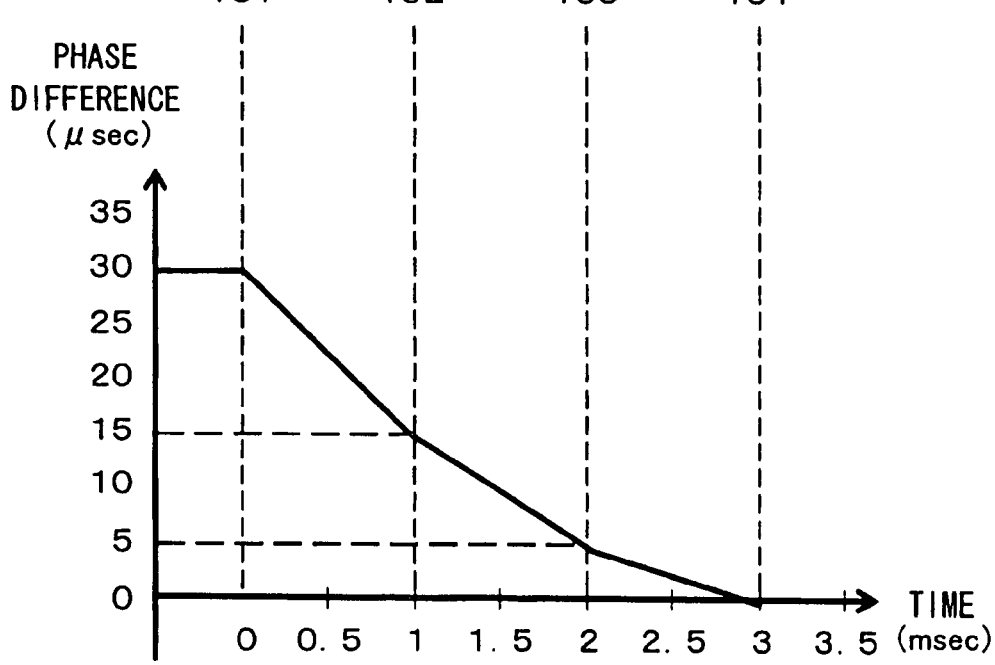

FIG. 12 is a graph showing an example of phase differences Δϕ that are calculated by the phase difference calculating part 913A and frequencies that are set by the frequency setting part 914A. Section (a) of FIG. 12 is a graph showing an example of frequencies set by the frequency setting part 914A, and Section (b) of FIG. 12 is a graph showing an example of phase differences Δϕ calculated by the phase difference calculating part 913A.

Here, the following description is about the case where the rotation phase of the polygon mirror 332 leads the reference phase corresponding to the reference phase signal S0 (see FIG. 10) by 30 microseconds (i.e., a rotation angle of 21.6 degrees (i.e., 30/1,000,000/(1/2,000)×360 degrees) (the case where the phase difference Δϕ is 30 microseconds). In addition, the phase difference calculating part 913A calculates the phase difference Δϕ every time when the beam detecting part 911A detects the laser beam, and here it calculates the phase difference Δϕ every 0.5 milliseconds (i.e., 1/2000) because the steady-state rotation frequency of the polygon motor 330 is 2.0 kHz.

As shown in Section (a) of FIG. 12, at the timing of time point T31, the phase difference calculating part 913A calculates the phase difference Δϕ to be 30 microseconds, and the frequency setting part 914A reads out the rotation frequency corresponding to the phase difference Δϕ from the frequency storing part 921A (see FIG. 11) so that the rotation frequency is set to a value of 1.97 kHz. Further, the frequency control part 915A controls rotation frequency of the polygon motor 330 from the steady-state rotation frequency (e.g., 2 kHz) to 1.97 kHz. Then, at the timing of time point T32 that is 1.0 milliseconds (i.e., time period corresponding to two periods of the steady-state rotation frequency (e.g., 2 kHz)) after the time point T31, the phase difference calculating part 913A calculates the phase difference Δϕ to be 15 microseconds, and the frequency setting part 914A reads out the rotation frequency corresponding to the phase difference Δϕ from the frequency storing part 921A (see FIG. 11) so that the rotation frequency is set to a value of 1.98 kHz. Further, the frequency control part 915A controls rotation frequency of the polygon motor 330 from 1.97 kHz to 1.98 kHz.

Next, at the timing of time point T33 that is 1.0 milliseconds (i.e., time period corresponding to two periods of the steady-state rotation frequency (e.g., 2 kHz)) after the time point T32, the phase difference calculating part 913A calculates the phase difference Δϕ to be 5 microseconds, and the frequency setting part 914A reads out the rotation frequency corresponding to the phase difference Δϕ from the frequency storing part 921A (see FIG. 11) so that the rotation frequency is set to a value of 1.99 kHz. Further, the frequency control part 915A controls the rotation frequency of the polygon motor 330 from 1.98 kHz to 1.99 kHz. Then, at the timing of time point T34 that is 1.0 milliseconds (i.e., time period corresponding to two periods of the steady-state rotation frequency (e.g., 2 kHz)) after the time point T33, the phase difference calculating part 913A calculates that the phase difference Δϕ is substantially zero microseconds, and the frequency setting part 914A reads out the rotation frequency corresponding to the phase difference Δϕ from the frequency storing part 921A (see FIG. 11) so that the rotation frequency is set to a value of 2.0 kHz. Further, the frequency control part 915A controls the rotation frequency of the polygon motor 330 from 1.99 kHz to 2.0 kHz (i.e., the steady-state rotation frequency).

In this way, the phase difference calculating part 913A calculates the phase difference Δϕ between the reference phase set by the reference phase setting part 912A and the rotation phase of the polygon mirrors 332, and the frequency setting part 914A reads out the rotation frequency corresponding to the phase difference Δϕ (see FIG. 11) and sets it. Further, the frequency control part 915A controls the rotation frequency of the polygon motors 330 to the rotation frequency that is set by the frequency setting part 914A. The actions described above are repeated every time when the beam detecting part 911A detects the laser beam (i.e., every 0.5 milliseconds), so that the phase difference Δϕ between the reference phase and the rotation phase of the polygon mirrors 332 changes as shown in Section (b) of FIG. 12. Thus, the rotation phase of the polygon mirror 332 becomes substantially the same as the reference phase corresponding to the reference phase signal S0 (see FIG. 10).

Figure 13A:
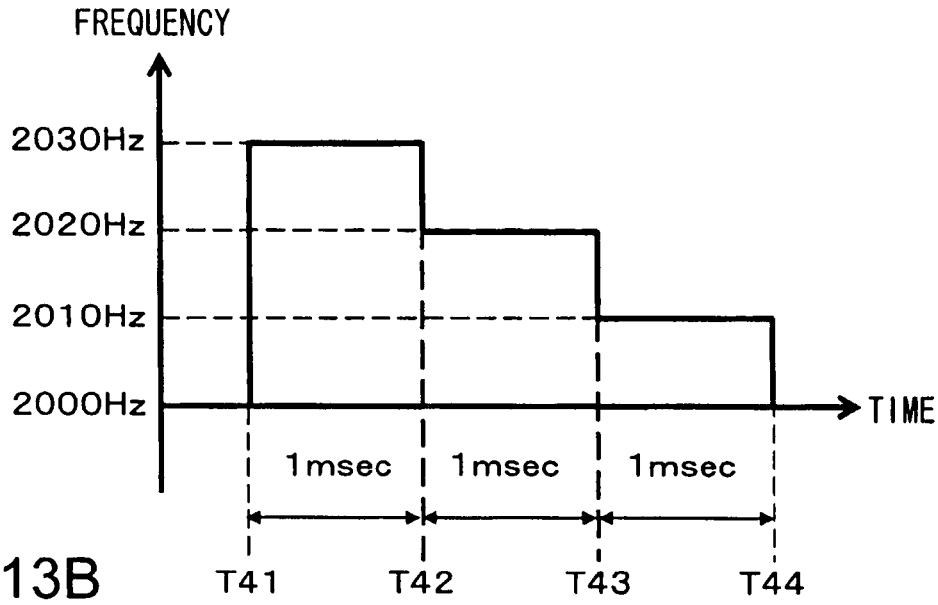
FIG. 13 is a graph showing another example of phase differences $\Delta\phi$ that are calculated by the phase difference calculating part and frequencies that are set by the frequency setting part, which are different from those shown in FIG. 12.
Figure 13B:
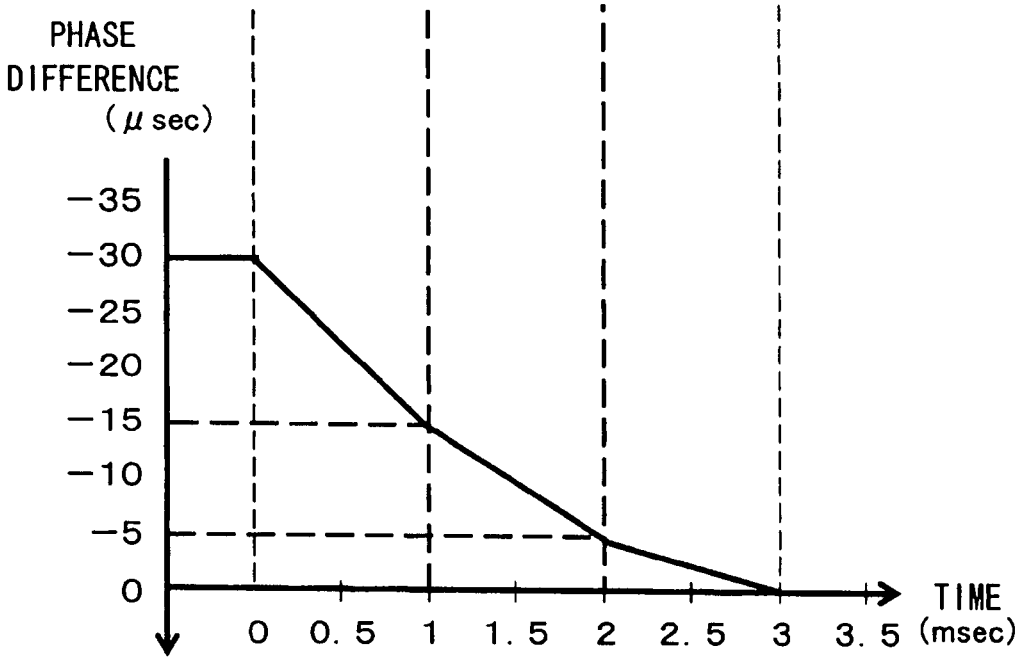

FIG. 13 is a graph showing another example of phase differences Δϕ calculated by the phase difference calculating part 913A and frequencies set by the frequency setting part 914A, which is different from those shown in FIG. 12. Section (a) of FIG. 13 is a graph showing an example of frequencies set by the frequency setting part 914A, and Section (b) of FIG. 13 is a graph showing an example of phase differences Δϕ calculated by the phase difference calculating part 913A.

Here, the following description is about the case where the rotation phase of the polygon mirror 332 lags from the reference phase corresponding to the reference phase signal S0 (see FIG. 10) by 30 microseconds (i.e., a rotation angle of 21.6 degrees (i.e., 30/1,000,000/(1/2,000)×360 degrees) (the case where the phase difference Δϕ is −30 microseconds). In addition, the phase difference calculating part 913A calculates the phase difference Δϕ every time when the beam detecting part 911A detects the laser beam, and here it calculates the phase difference Δϕ every 0.5 milliseconds (i.e., 1/2000) because the steady-state rotation frequency of the polygon motor 330 is 2.0 kHz.

As shown in Section (a) of FIG. 13, at the timing of time point T41, the phase difference calculating part 913A calculates the phase difference Δϕ to be −30 microseconds, and the frequency setting part 914A reads out the rotation frequency corresponding to the phase difference Δϕ from the frequency storing part 921A (see FIG. 11) so that the rotation frequency is set to a value of 2.03 kHz. Further, the frequency control part 915A controls rotation frequency of the polygon motor 330 from the steady-state rotation frequency (e.g., 2 kHz) to 2.03 kHz. Then, at the timing of time point T42 that is 1.0 milliseconds (i.e., time period corresponding to two periods of the steady-state rotation frequency (e.g., 2 kHz)) after the time point T41, the phase difference calculating part 913A calculates the phase difference Δϕ to be −15 microseconds, and the frequency setting part 914A reads out the rotation frequency corresponding to the phase difference Δϕ from the frequency storing part 921A (see FIG. 11) so that the rotation frequency is set to a value of 2.02 kHz. Further, the frequency control part 915A controls rotation frequency of the polygon motor 330 from 2.03 kHz to 2.02 kHz.

Next, at the timing of time point T43 that is 1.0 milliseconds (i.e., time period corresponding to two periods of the steady-state rotation frequency (e.g., 2 kHz)) after the time point T42, the phase difference calculating part 913A calculates the phase difference Δϕ to be −5 microseconds, and the frequency setting part 914A reads out the rotation frequency corresponding to the phase difference Δϕ from the frequency storing part 921A (see FIG. 11) so that the rotation frequency is set to a value of 2.01 kHz. Further, the frequency control part 915A controls the rotation frequency of the polygon motor 330 from 2.02 kHz to 2.01 kHz. Then, at the timing of time point T44 that is 1.0 milliseconds (i.e., time period corresponding to two periods of the steady-state rotation frequency (e.g., 2 kHz)) after the time point T43, the phase difference calculating part 913A calculates that the phase difference Δϕ is substantially zero microseconds, and the frequency setting part 914A reads out the rotation frequency corresponding to the phase difference Δϕ from the frequency storing part 921A (see FIG. 11) so that the rotation frequency is set to a value of 2.0 kHz. Further, the frequency control part 915A controls the rotation frequency of the polygon motor 330 from 2.01 kHz to 2.0 kHz (i.e., steady-state rotation frequency).

In this way, the phase difference calculating part 913A calculates the phase difference Δϕ between the reference phase set by the reference phase setting part 912A and the rotation phase of the polygon mirrors 332, and the frequency setting part 914A reads out the rotation frequency corresponding to the phase difference Δϕ (see FIG. 11) and sets it. Further, the frequency control part 915A controls the rotation frequency of the polygon motor 330 to the rotation frequency that is set by the frequency setting part 914A. The actions described above are repeated every time when the beam detecting part 911A detects the laser beam (i.e., every 0.5 milliseconds), so that the phase difference Δϕ between the reference phase and the rotation phase of polygon mirrors 332 changes as shown in Section (b) of FIG. 12. Thus, the rotation phase of the polygon mirror 332 becomes substantially the same as the reference phase corresponding to the reference phase signal S0 (see FIG. 10).

Figure 14:
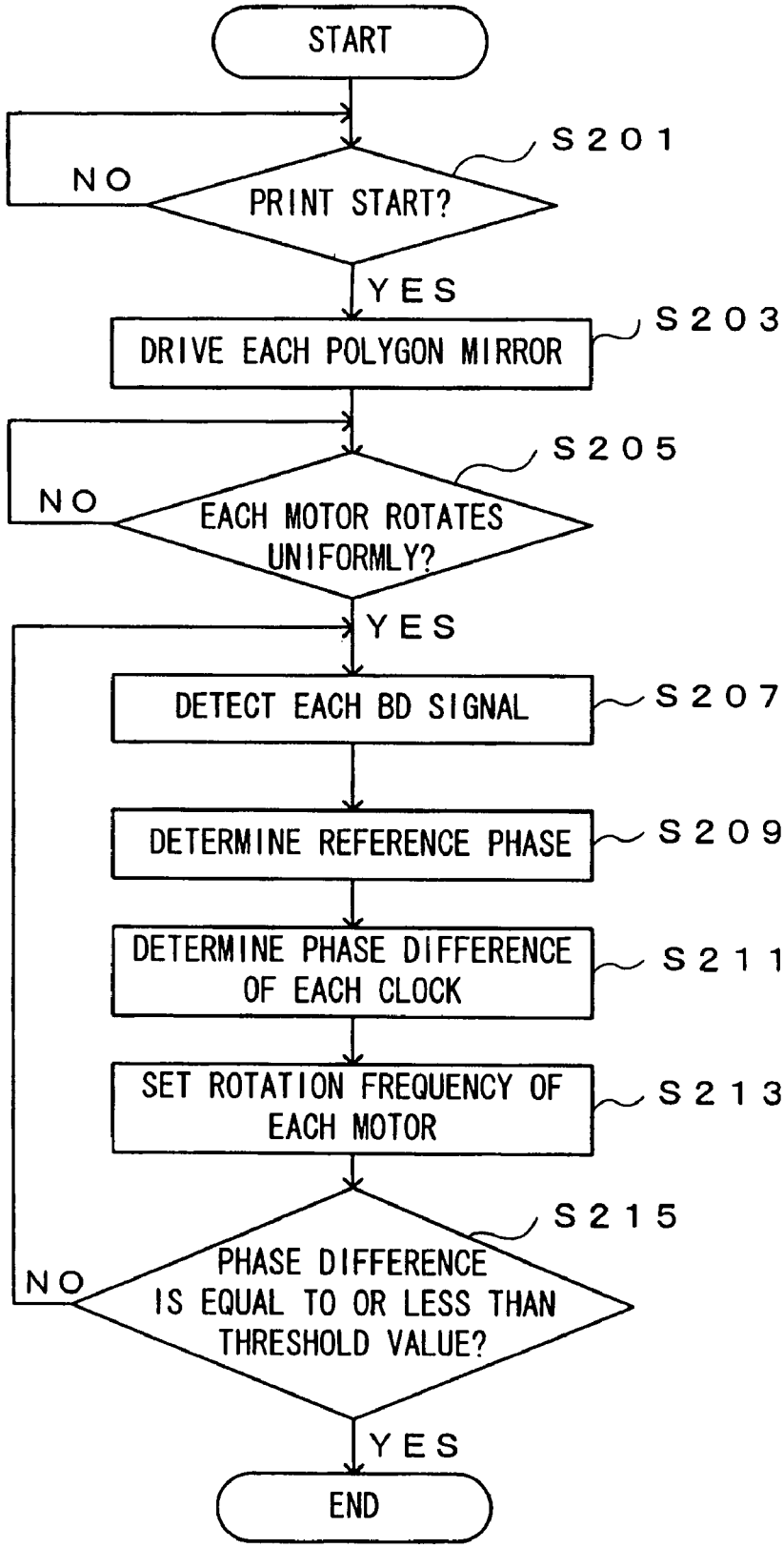
FIG. 14 is a flowchart showing an example of a printer (mainly a CPU) according to the second embodiment of the present invention.

FIG. 14 is a flowchart showing an example of actions of the printer 100 (mainly CPU 91A). Here, the case where the printer 100 is in the standby state as an initial state (i.e., the state where the polygon motor 330 for driving the polygon mirror 332 is not driven) will be described. First, the reference phase setting part 912A determines whether or not the personal computer (PC) or the like has issued instruction information for starting to print (S201). Then, if it is determined that the instruction information for starting to print is not issued (NO in S201), the process becomes the standby state.

If it is determined that the instruction information for starting to print is issued (YES in S201), the reference phase setting part 912A starts to drive the polygon motor 330 (S203). Then, the reference phase setting part 912A determines whether or not the polygon motor 330 has become uniform rotation at the steady-state rotation frequency (e.g., 2 kHz) (S205). If it is determined that it has not become uniform rotation (NO in S205), the process becomes the standby state. If it is determined that it has become uniform rotation (YES in S205), the beam detecting part 911A generates the BD signal via the beam sensor 335 (S207).

Then, the reference phase setting part 912A sets the reference phase that is a phase to be a reference of the rotation phase of the polygon mirror 332, based on a result of detection by the beam detecting part 911A (i.e., the BD signal) (S209). Next, the phase difference calculating part 913A calculates each phase difference Δϕ between each of the rotation phases of a predetermined number (e.g., four) of polygon mirrors 332 and the reference phase corresponding to the reference phase signal S0 (see FIG. 10) (S211).

Then, the frequency setting part 914A reads out the rotation frequency corresponding to the phase difference Δϕ calculated in the step S211 from the frequency storing part 921A, and the frequency control part 915A changes the rotation frequency of the polygon motor 330 (S213). Next, the frequency setting part 914A determines whether or not the phase difference Δϕ is equal to or less than the threshold value (e.g., whether or not "−2 microseconds<Δϕ<2 microseconds" holds) (S215). If it is determined that it is not equal to or less than the threshold value (e.g., "−Δϕ≦2 microseconds" or "Δϕ≧2 microseconds" holds) (NO in S215), the process goes back to the step S207, and the process after the step S207 is performed repeatedly. If it is determined that it is equal to or less than the threshold value (e.g., −2 microseconds<Δϕ<2 microseconds" holds) (YES in S215), the process is finished.

In this way, every time when the beam detecting part 911A detects the laser beam via the beam sensor 335, rotation frequencies of the predetermined number (e.g., four) of polygon motors 330 are controlled in accordance with phase difference Δϕ determined based on a result of the detection. Therefore, rotation phases of the polygon mirrors 332 can match each other efficiently. In other words, the rotation frequency is set to a value such that a frequency difference from the steady-state rotation frequency (e.g., 2 kHz) is larger as the phase difference Δϕ is larger, for example. Thus, rotation phase of the polygon mirror 332 can be made close to the reference phase swiftly.

In addition, among rotation phases of the predetermined number (e.g., four) of polygon mirrors 332, the substantially intermediate phase between the most leading phase and the most lagging phase is set as the reference phase. Thus, the rotation phases of the polygon mirrors 332 can match each other more efficiently.

In other words, according to the conventional method, the polygon motor 330 should be controlled so that a rotation phase of the polygon mirror 332 is changed by a phase difference between the most leading phase and the most lagging phase. In contrast, according to the present invention, since substantially intermediate phase between the most leading phase and the most lagging phase is set as the reference phase, it is sufficient to control the polygon motor 330 so that a rotation phase of the polygon mirror 332 is changed by substantially a half of the phase difference between the most leading phase and the most lagging phase. Therefore, rotation phases of the polygon mirrors 332 can match each other more efficiently.

Further, the rotation frequency is set to a value such that a frequency difference from the steady-state rotation frequency (e.g., 2 kHz) is larger as the absolute value of the phase difference Δϕ between the rotation phase of the predetermined number (e.g., four) of polygon mirrors 332 and the reference phase is larger (see FIG. 11). Therefore, decreasing amount of the phase difference between each of the rotation phases of the predetermined number (e.g., four) of polygon mirrors 332 and the reference phase per unit time (e.g., one millisecond) increases. Thus, rotation phases of the polygon mirrors 332 can match each other more efficiently.

In addition, since the rotation frequency corresponding to the phase difference Δϕ determined by the phase difference calculating part 913A is read out from the frequency storing part 921A so that the rotation frequency is set, an appropriate frequency can be set by a simple structure.

Further, the rotation frequency of the polygon motor 330 is controlled via the PLL (Phase Locked Loop) of the motor driver 374A, and the frequency storing part 921A stores the rotation frequency so that a difference from the steady-state rotation frequency is within a preset predetermined range (e.g., equal to or less than 100 Hz). Therefore, the PLL is prevented from getting out of the locked state so that the rotation phases of the polygon mirrors 332 can match each other more efficiently.

Note that the present invention can also be embodied as follows.

(D) Although in the second embodiment the reference phase setting part 912A sets the intermediate phase between the most leading phase and the most lagging phase as the reference phase among rotation phases of a predetermined number (e.g., four) of polygon mirrors 332 based on a result of detection by the predetermined number (e.g., four) of beam sensors 335, the reference phase setting part 912A may set the reference phase by other methods.

For example, the reference phase setting part 912A may determine the intermediate phase between the most leading phase and the most lagging phase among rotation phases of a predetermined number (e.g., four) of polygon mirrors 332, and may set rotation phase of the polygon mirror 332 that is closest to the determined intermediate phase as the reference phase (the BD signal SY corresponding to yellow (Y) is set as the reference phase signal S0 in the example shown in FIG. 10).

(E) Although in the second embodiment the frequency setting part 914A sets the rotation frequency by reading out the rotation frequency corresponding to the phase difference Δϕ determined by the phase difference calculating part 913A from the frequency storing part 921A, the frequency setting part 914A may set the rotation frequency corresponding to the phase difference Δϕ by other methods. For example, the frequency setting part 914A may calculate the rotation frequency from the phase difference Δϕ by using a preset predetermined equation (e.g., the equation (1) as below). In this case, more appropriate frequency can be set.

$$\text{rotation frequency}=2.0-\Delta\phi(\text{microseconds})\times 0.01 \quad (1)$$

(F) Although in the second embodiment the frequency storing part 921A stores rotation frequency of the polygon motor 330 in association with the phase difference Δϕ between the reference phase set by the reference phase setting part 912A and the rotation phase of the polygon motor 330, the frequency storing part 921A may store rotation frequencies of the polygon motor 330 corresponding to each color (e.g., each color of magenta (M), cyan (C), yellow (Y) and black (K)) in association with the phase difference Δϕ. In this case, more appropriate frequency can be set.

What is claimed is:

1. An image forming apparatus that forms a color image through the steps of forming latent images by applying laser beams to photosensitive drums via polygon mirrors for a predetermined number of colors that is two or more, forming toner images corresponding to the formed latent images, and superposing the toner images of the predetermined number of colors to be transferred to a paper sheet, the image forming apparatus comprising:

a number of polygon driving portions, equal to the predetermined number, that drive a number of polygon mirrors, equal to the predetermined number, to rotate at preset steady-state rotation frequencies;

a number of beam detecting portions, equal to the predetermined number, that detect laser beams scanning by the predetermined number of polygon mirrors at preset positions on scanning paths;

a reference phase setting portion that sets a substantially intermediate phase between a most leading phase and a most lagging phase among rotation phases of the predetermined number of polygon mirrors as a reference phase that is a phase to be a reference of the rotation phases of the predetermined number of polygon mirrors based on a result of detection by the predetermined number of beam detecting portions; and a phase control portion that controls the polygon driving portions so that rotation phases of the predetermined number of polygon mirrors match the reference phase.

2. The image forming apparatus according to claim 1, wherein the phase control portion controls the polygon driving portions so that rotation phases of the predetermined number of polygon mirrors match the reference phase by sequentially increasing or decreasing rotation frequencies of the predetermined number of polygon driving portions in stages by a preset predetermined frequency.

3. The image forming apparatus according to claim 2, wherein the polygon driving portions control the rotation frequencies via PLL (Phase Locked Loop), and the predetermined frequency is set to a value equal to or less than a preset threshold value.

4. The image forming apparatus according to claim 3, wherein if rotation phases of the predetermined number of polygon mirrors lag from the reference phase, the phase control portion sequentially increases a rotation frequency of a corresponding polygon driving portion from the steady-state rotation frequency in stages by a preset predetermined frequency and then decreases in stages by a preset predetermined frequency sequentially to the steady-state rotation frequency, and if the rotation phases of the predetermined number of polygon mirrors lead the reference phase, the phase control portion sequentially decreases the rotation frequency of the corresponding polygon driving portion from the steady-state rotation frequency in stages by a preset predetermined frequency and then increases in stages by a preset predetermined frequency sequentially to the steady-state rotation frequency.

5. The image forming apparatus according to claim 4, further comprising a pattern storing portion that stores change patterns for changing the rotation frequency of the polygon driving portions corresponding to a phase difference between a rotation phase of the polygon mirrors and the reference phase, wherein the phase control portion calculates phase differences between rotation phases of the predetermined number of polygon mirrors and the reference phase, reads out a change pattern corresponding to a calculated phase difference from the pattern storing portion, and controls the rotation frequencies of the predetermined number of polygon driving portions based on the read change pattern.

6. The image forming apparatus according to claim 1, wherein the phase control portion includes a phase difference calculating portion that determines phase differences between the reference phase set by the reference phase setting portion and the rotation phases of the predetermined number of polygon mirrors based on a result of detection every time the predetermined number of beam detecting portions detect laser beams, a frequency setting portion that sets rotation frequencies of the predetermined number of polygon driving portions based on the phase differences determined by the phase difference calculating portion, and a frequency control portion that controls the rotation frequencies of the predetermined number of polygon driving portions to be the rotation frequency set by the frequency setting portion.

7. The image forming apparatus according to claim 6, wherein the reference phase setting portion sets one rotation phase of a polygon mirror as the reference phase among the predetermined number of polygon mirrors.

8. The image forming apparatus according to claim 6, wherein the reference phase setting portion sets a substantially intermediate phase between the most leading phase and the most lagging phase as the reference phase among rotation phases in the predetermined number of polygon mirrors based on a result of detection by the predetermined number of beam detecting portions.

9. The image forming apparatus according to claim 8, wherein the frequency setting portion is configured such that the absolute difference between the rotation frequency set to a polygon driving portion relative to the steady-state rotation frequency, increases is made to be larger as an absolute phase difference, between the rotation phase of the associated polygon mirror and the reference phase, is determined to be larger.

10. The image forming apparatus according to claim 9, further comprising a frequency storing portion that stores a rotation frequency in association with the phase difference, wherein the frequency setting portion sets the rotation frequency by reading out a rotation frequency corresponding to the phase difference determined by the phase difference calculating portion from the frequency storing portion.

11. The image forming apparatus according to claim 10, wherein the polygon driving portions control the rotation frequencies via PLL (Phase Locked Loop), and the frequency storing portion stores the rotation frequency that is set so as to make a difference between the stored rotation frequency and the steady-state rotation frequency be a value within a preset predetermined range.

12. An image forming method for use in an image forming apparatus that forms a color image through the steps of forming latent images by applying laser beams to photosensitive drums via polygon mirrors for a predetermined number of colors, forming toner images corresponding to the formed latent images, and superposing the toner images of the predetermined number of colors to be transferred to a paper sheet, the image forming apparatus including: a number of polygon driving portions, equal to the predetermined number, that drive a number of polygon mirrors, equal to the predetermined number, to rotate at preset steady-state rotation frequencies; and a number of beam detecting portions, equal to the predetermined number, that detect laser beams scanning by the predetermined number of polygon mirrors at preset positions on scanning paths, wherein the image forming method involves performing:

a reference phase setting step for setting a substantially intermediate phase between a most leading phase and a most lagging phase among rotation phases of the predetermined number of polygon mirrors as a reference phase that is a phase to be a reference of the rotation phases of the predetermined number of polygon mirrors based on a result of detection by the predetermined number of beam detecting portions; and a phase control step for controlling the polygon driving portions so that rotation phases of the predetermined number of polygon mirrors match the reference phase.

13. The image forming method according to claim 12, wherein in the phase control step, control is performed so that rotation phases of the predetermined number of polygon mirrors match the reference phase by sequentially increasing or decreasing rotation frequencies of the predetermined number of polygon driving portions in stages by a preset predetermined frequency.

14. The image forming method according to claim 13, wherein in the phase control step, if rotation phases of the predetermined number of polygon mirrors lag from the reference phase, a rotation frequency of a corresponding polygon driving portion is sequentially increased from the steady-state rotation frequency in stages by a preset predetermined frequency and is then sequentially decreased in stages by a preset predetermined frequency to the steady-state rotation frequency, and if the rotation phases of the predetermined number of polygon mirrors lead the reference phase, a rotation frequency of a corresponding polygon driving portion is sequentially decreased from the steady-state rotation frequency in stages by a preset predetermined frequency and is then sequentially increased in stages by a preset predetermined frequency to the steady-state rotation frequency.

15. The image forming method according to claim 12, wherein the phase control step involves performing:

a phase difference calculating step for determining phase differences between the reference phase set in the reference phase setting step and the rotation phases of the predetermined number of polygon mirrors based on a result of detection every time the predetermined number of beam detecting portions detect laser beams;

a frequency setting step for setting rotation frequencies of the predetermined number of polygon driving portions based on the phase differences determined in the phase difference calculating step; and a frequency control step for controlling the rotation frequencies of the predetermined number of polygon driving portions to be the rotation frequency set in the frequency setting step.

16. The image forming method according to claim 15, wherein in the reference phase setting step, one rotation phase of a polygon mirror among the predetermined number of polygon mirrors is set as the reference phase.

17. The image forming method according to claim 15, wherein in the reference phase setting step, a substantially intermediate phase between the most leading phase and the most lagging phase among rotation phases in the predetermined number of polygon mirrors is set as the reference phase based on a result of detection by the predetermined number of beam detecting portions.

18. The image forming method according to claim 17, wherein in the frequency setting step, the absolute difference between the rotation frequency set to a polygon driving portion relative to the steady-state rotation frequency, is made to be larger as an absolute phase difference, between the rotation phase of the associated polygon mirror and the reference phase, is determined to be larger.

* * * * *